US008998653B2

(12) United States Patent
Kamiya

(10) Patent No.: US 8,998,653 B2
(45) Date of Patent: Apr. 7, 2015

(54) INSERTION/EXTRACTION FORCE REDUCING CONNECTOR

(71) Applicant: Yazaki Corporation, Minato-ku, Tokyo (JP)

(72) Inventor: Jun Kamiya, Makinohara (JP)

(73) Assignee: Yazaki Corporation, Tokyo (JP)

( * ) Notice: Subject to any disclaimer, the term of this patent is extended or adjusted under 35 U.S.C. 154(b) by 9 days.

(21) Appl. No.: 13/969,667

(22) Filed: Aug. 19, 2013

(65) Prior Publication Data

US 2014/0057476 A1 Feb. 27, 2014

(30) Foreign Application Priority Data

Aug. 24, 2012 (JP) ..... 2012-185746

(51) Int. Cl.

| | |
|---|---|
| ***H01R 13/502*** | (2006.01) |
| ***H01R 13/62*** | (2006.01) |
| ***H01R 13/514*** | (2006.01) |
| ***H01R 13/516*** | (2006.01) |
| ***H01R 13/627*** | (2006.01) |
| ***H01R 13/629*** | (2006.01) |
| ***H01R 13/631*** | (2006.01) |

(52) U.S. Cl.

CPC ..... *H01R 13/62* (2013.01); *H01R 13/514* (2013.01); *H01R 13/516* (2013.01); *H01R 13/627* (2013.01); *H01R 13/629* (2013.01); *H01R 13/631* (2013.01)

(58) Field of Classification Search

USPC ..... 439/701, 712, 752, 924.1

See application file for complete search history.

(56) References Cited

U.S. PATENT DOCUMENTS

| | | | | |
|---|---|---|---|---|
| 5,344,347 | A | 9/1994 | Inoue et al. | |
| 5,775,953 | A * | 7/1998 | Yamanashi et al. | 439/701 |
| 5,913,703 | A * | 6/1999 | Suzuki et al. | 439/701 |

FOREIGN PATENT DOCUMENTS

JP 2671729 B2 10/1997

* cited by examiner

*Primary Examiner* — Vanessa Girardi

(74) *Attorney, Agent, or Firm* — Sughrue Mion, PLLC

(57) ABSTRACT

A second connector housing 20 to be fitted into a first connector housing 10 is equipped with a first housing 21 which holds second terminal metal fittings belonging to a first group and a second housing 22 integrally formed with the first housing 21. The second housing 22 holds second terminal metal fittings belonging to a second group. The second housing 22 is connected slidably to a portion located on the one side of the first housing 21 so that during a manipulation for fitting the second connector housing 20 into the first connector housing 10 fitting of the second terminal metal fittings belonging to the second group with corresponding ones of the first terminal metal fittings is completed earlier than fitting of the second terminal metal fittings belonging to the first group.

4 Claims, 23 Drawing Sheets

INSERTION/EXTRACTION FORCE REDUCING CONNECTOR

BACKGROUND OF THE INVENTION

1. Field of the Invention

The present invention relates to an insertion/extraction force reducing connector which can reduce manipulation force that is necessary in inserting or pulling one connector housing into or out of the other.

2. Description of the Related Art

In connectors used in connection portions of vehicle wire harnesses, the number of terminals of a connector is increasing as vehicles are coming to be equipped with more electric devices. And the manipulation force that is necessary in inserting or pulling one connector housing of a connector into or out of the other is increasing accordingly.

Increased manipulation force not only makes difficult a manipulation of inserting or pulling one connector housing of a connector into or out of the other but also may cause a fitting failure or the like of connected connector housings.

Therefore, multi-terminal connectors are desired to be insertion/extraction force reducing connectors (low insertion force connectors) which can reduce manipulation force that is necessary in inserting or pulling one connector housing into or out of the other. Various lever connectors have been proposed as insertion/extraction force reducing connectors.

Lever connectors are connectors in which a fitting manipulation lever which, when rotated, causes forces in the insertion/extraction direction to act on a pair of connector housings to be fitted with and connected to each other is provided between the pair of connector housings. Through leverage, the fitting manipulation lever can reduce manipulation force that is necessary in inserting or pulling one connector housing into or out of the other.

However, to reduce the manipulation force to a large extent in lever connectors, it is necessary to use a large fitting manipulation lever having a large leverage ratio. The use of a large fitting manipulation lever raises a problem that the size of the connector is increased.

In view of the above, an insertion/extraction force reducing connector 100 shown in FIG. 30 has been proposed which reduces manipulation force that is necessary in inserting or pulling one connector housing into or out of the other without using a fitting manipulation lever (refer to the following Japanese Patent No. 2,671,729).

The insertion/extraction force reducing connector 100 is composed of a first connector housing 110 and a second connector housing 120 to be connected to the former.

The first connector housing 110 is equipped with a first terminal holding part 112 which holds plural first terminal metal fittings 111 and a cylindrical hood part 113 which extends from a front outer circumferential portion of the first terminal holding part 112 and is to be fitted with and connected to the second connector housing 120.

The first terminal metal fittings 111 which are held by the first terminal holding part 112 are tongue-shaped male terminal metal fittings (tab terminal metal fittings).

The second connector housing 120 holds plural second terminal metal fittings (not shown) to be fitted with and connected to the respective first terminal metal fittings 111 of the first connector housing 110 in such a manner that they are divided into two groups, that is, a first group and a second group. The second terminal metal fittings are fitted with and connected to the first terminal metal fittings 111 of the first connector housing 110 by fitting a front portion of the second connector housing 120 into the hood part 113 of the first connector housing 110.

The second connector housing 120 used in Japanese Patent No. 2,671,729 is equipped with an outer housing 124 and an inner housing 126. The outer housing 124 has a first group terminal holding part 123 which houses and holds the second terminal metal fittings belonging to the first group, and is to be fitted into the hood part 113. The inner housing 126 has a second group terminal holding part 125 which houses and holds the second terminal metal fittings belonging to the second group, and is attached to the outer housing 124.

The outer housing 124 has, adjacent to the first group terminal holding part 123, an inner housing space 124*a* in which the inner housing 126 is inserted for attachment.

In the inner housing 126, the second group terminal holding part 125 is temporarily locked in the outer housing 124 (placed in the inner housing space 124*a*) in such a manner that the second group terminal holding part 125 project from the level of the first group terminal holding part 123. Therefore, when the second connector housing 120 is fitted into the first connector housing 110, the second terminal metal fittings that are held by the second group terminal holding part 125 are fitted with and connected to the associated ones of first terminal metal fittings 111 of the first connector housing 110 earlier than those held by the first group terminal holding part 123 are.

When the second terminal metal fittings which are held by the second group terminal holding part 125 have been completely fitted with and connected to the associated ones of first terminal metal fittings 111 of the first connector housing 110, the temporary lock state of the inner housing 126 is canceled, whereupon the tip surface of the second group terminal holding part 125 is allowed to retract to such a position as to be flush with the tip surface of the first group terminal holding part 123. As the inner housing 126 retracts, fitting of the second terminal metal fittings that are held by the first group terminal holding part 123 with the associated ones of the first terminal metal fittings 111 of the first connector housing 110 proceeds.

In the insertion/extraction force reducing connector 100 disclosed in Japanese Patent No. 2,671,729, the second terminal metal fittings that are held by the second connector housing 120 are divided into two groups and are fitted in order on a group-by-group basis. In this manner, the manipulation force that is necessary in fitting one connector housing to or with the other is reduced.

Since no fitting manipulation lever is used for a manipulation for fitting one connector housing to or with the other, the size of the connector can be reduced.

However, in the insertion/extraction force reducing connector disclosed in Japanese Patent No. 2,671,729, the second connector housing 120 is configured in such a manner that the inner housing 126 is inserted in and attached to the outer housing 124. The outer housing 124 has an outside wall 124*b* with which the entire outer circumferential surface of the inner housing 126 is covered, the outside wall 124*b* causes increase in volume and weight. This raises a problem that the size and the weight cannot be reduced very much from conventional lever connectors.

SUMMARY OF THE INVENTION

The present invention has been made to solve the above problems, and an object of the invention is therefore to provide an insertion/extraction force reducing connector which enables size and weight reduction and can reduce insertion/extraction force further.

The above object of the invention can be attained by the following:

(1) An insertion/extraction force reducing connector comprising:

a first connector housing having a first terminal holding part which holds plural first terminal metal fittings, and a hood part which extends cylindrically from a front outer circumferential portion of the first terminal holding part and to which a second connector housing is connected and fitted; and the second connector housing which holds plural second terminal metal fittings to be fitted with and connected to the respective first terminal metal fittings, and in which the second terminal metal fittings are fitted with and connected to the respective first terminal metal fittings when the second connector housing is fitted into the hood part;

wherein the second connector housing holds the second terminal metal fittings in such a manner that the second terminal metal fitting are divided into plural groups, and when the second connector housing is inserted into or pulled out of the first connector housing, sets of the second terminal metal fittings belonging to the respective groups are engaged with or pulled out of associated sets of first terminal metal fittings in order on a group-by-group basis;

the second connector housing comprises:

a first housing which holds second terminal metal fittings belonging to a first group and is to be fitted into the hood part; and a second housing which is positioned at a temporary lock position on one side of the first housing by a first support arm which is integrally formed with the first housing and are located on the one side of the first housing and which holds second terminal metal fittings belonging to a second group which are disposed adjacent to the second terminal metal fittings belonging to the first group on the one side of the first housing; and the second housing is connected slidably to a portion located on the one side of the first housing so that during a fitting manipulation for fitting the second connector housing into the first connector housing, fitting of the second terminal metal fittings belonging to the second group with corresponding ones of the first terminal metal fittings is completed earlier than fitting of the second terminal metal fittings belonging to the first group.

(2) The insertion/extraction force reducing connector according to item (1), wherein when the fitting of the second terminal metal fittings belonging to the second group with the corresponding ones of the first terminal metal fittings has been completed, temporary locking of the second housing on the first housing by the first support arms is canceled and relative displacement between the first housing and the second housing which is necessary for the fitting of the second terminal metal fittings belonging to the first group with the corresponding ones of the first terminal metal fittings is thereby permitted; and during a detachment manipulation for detaching the second connector housing from the first connector housing, the second terminal metal fittings belonging to the first group and the second terminal metal fittings belonging to the second group are detached from the first terminal metal fittings in this order which is opposite to the order at the time of the fitting manipulation and the same state as at the time of a start of the fitting manipulation is restored that the second housing is connected to the first housing by the first support arms at the temporary lock position on the one side of the first housing.

(3) The insertion/extraction force reducing connector according to item (2), further comprising a third housing which is positioned at a temporary lock position on the other side of the first housing by second support arms which are integrally formed with the first housing and are located on the other side of it, and which holds second terminal metal fittings belonging to a third group which are disposed adjacent to the second terminal metal fittings belonging to the first group on the other side of the latter; and the third housing is connected slidably to a portion, located on the other side, of the first housing so that during the fitting manipulation for fitting the second connector housing into the first connector housing fitting of the second terminal metal fittings belonging to the third group with corresponding ones of the first terminal metal fittings is completed earlier than fitting of the second terminal metal fittings belonging to the second group is.

(4) The insertion/extraction force reducing connector according to item (3), wherein when the fitting of the second terminal metal fittings belonging to the third group with the corresponding ones of the first terminal metal fittings has been completed, temporary locking of the third housing on the first housing by the second support arms is canceled and relative displacement between the first housing and the third housing which is necessary for the fitting of the second terminal metal fittings belonging to the second group with the corresponding ones of the first terminal metal fittings is thereby permitted; and during the detachment manipulation for detaching the second connector housing from the first connector housing, the second terminal metal fittings belonging to the first group, the second terminal metal fittings belonging to the second group, and the second terminal metal fittings belonging to the third group are detached from the first terminal metal fittings in this order which is opposite to the order at the time of the fitting manipulation and the same state as at the time of a start of the fitting manipulation is restored that the second housing is connected to the first housing by the first support arms at the temporary lock position on the one side of the first housing and the third housing is connected to the first housing by the second support arms at the temporary lock position on the other side of the first housing.

In the configuration of item (1), the second terminal metal fittings are held so as to be divided into at least two groups by the second connector housing which is to be fitted into the first connector housing. When the second connector housing is inserted into or pulled out of the first connector housing, the sets of second terminal metal fittings belonging to the respective groups are engaged with or pulled out of the associated sets of first terminal metal fittings of the first connector housing in order on a group-by-group basis. Therefore, the manipulation force that is necessary in inserting or pulling the second connector housing into or out of the first connector housing can be made weaker than in the case that all the second terminal metal fittings held by the second connector housing are engaged with or pulled out of the first terminal metal fittings at one time.

The first housing and the second housing which are parts of the second connector housing are connected to each other using the first support arms which are integrally formed with the first housing. Therefore, the total volume and weight of the members that are necessary for the connections between the housings can be made much smaller than in the conventional connector in which the inner housing space in which the inner housing is inserted for attachment is formed in the outer housing.

As a result, not only can the manipulation force that is necessary in inserting or pulling the second connector housing into or out of the first connector housing be reduced, but they can also be reduced in size and weight effectively.

In the configuration of item (2), at the time of a detachment manipulation for detaching the second connector housing from the first connector housing, the same state as at the time of the start of a fitting manipulation is restored, that is, the second housing is connected to the first housing by the first support arms at the temporary lock position on the one side of the latter. Therefore, to fit the second connector housing which has been detached from the first connector housing into the first connector housing again, no time and labor to adjust the positional relationships between the first housing and the second housing which are parts of the second connector housing are necessary. Thus, the second connector housing can be re-connected to the first connector housing easily, which means high ease of handling.

In the configuration of item (3), the second terminal metal fittings are held by the second connector housing so as to be divided into at least three groups. When the second connector housing is inserted into or pulled out of the first connector housing, the sets of second terminal metal fittings belonging to the respective groups are engaged with or pulled out of the associated sets of first terminal metal fittings of the first connector housing in order on a group-by-group basis. Therefore, the manipulation force that is necessary in inserting or pulling the second connector housing into or out of the first connector housing can be made weaker than in the case that the second terminal metal fittings are divided into two groups and are engaged with or pulled out of the first terminal metal fittings of a first connector housing in order on a group-by-group basis, by a degree corresponding to the increase in the number of division.

In the configuration of item (4), at the time of a detachment manipulation for detaching the second connector housing from the first connector housing, the same state as at the time of the start of a fitting manipulation is restored, that is, the second housing is connected to the first housing by the first support arms at the temporary lock position on the one side of the latter and the third housing is connected to the first housing by the second support arms at the temporary lock position on the other side of the latter. Therefore, to fit the second connector housing which has been detached from the first connector housing into the first connector housing again, no time and labor to adjust the positional relationships between the first housing, the second housing, and the third housing which are parts of the second connector housing are necessary. Thus, the second connector housing can be re-connected to the first connector housing easily, which means high ease of handling.

In the insertion/extraction force reducing connector according to the invention, the second terminal metal fittings are held so as to be divided into at least two groups by the second connector housing which is to be fitted into the first connector housing. When the second connector housing is inserted into or pulled out of the first connector housing, the sets of second terminal metal fittings belonging to the respective groups are engaged with or pulled out of the associated sets of first terminal metal fittings of the first connector housing in order on a group-by-group basis. Therefore, the manipulation force that is necessary in inserting or pulling the second connector housing into or out of the first connector housing can be made weaker than in the case that all the second terminal metal fittings held by the second connector housing are engaged with or pulled out of the first terminal metal fittings at one time.

The first housing and the second housing which are parts of the second connector housing are connected to each other using the first support arms which are integrally formed with the first housing. Therefore, the total volume and weight of the members that are necessary for the connections between the housings can be made much smaller than in the conventional connector in which the inner housing space in which the inner housing is inserted for attachment is formed in the outer housing. As a result, not only can the manipulation force that is necessary in inserting or pulling the second connector housing into or out of the first connector housing be reduced, but they can also be reduced in size and weight effectively.

The invention has been described above briefly. The details of the invention will become more apparent when the following modes for carrying out the invention (hereinafter referred to as an embodiment) are read with reference to the accompanying drawings.

DESCRIPTION OF THE PREFERRED EMBODIMENTS

An insertion/extraction force reducing connector according to a preferred embodiment of the present invention will be hereinafter described in detail with reference to the drawings.

Figure 1:
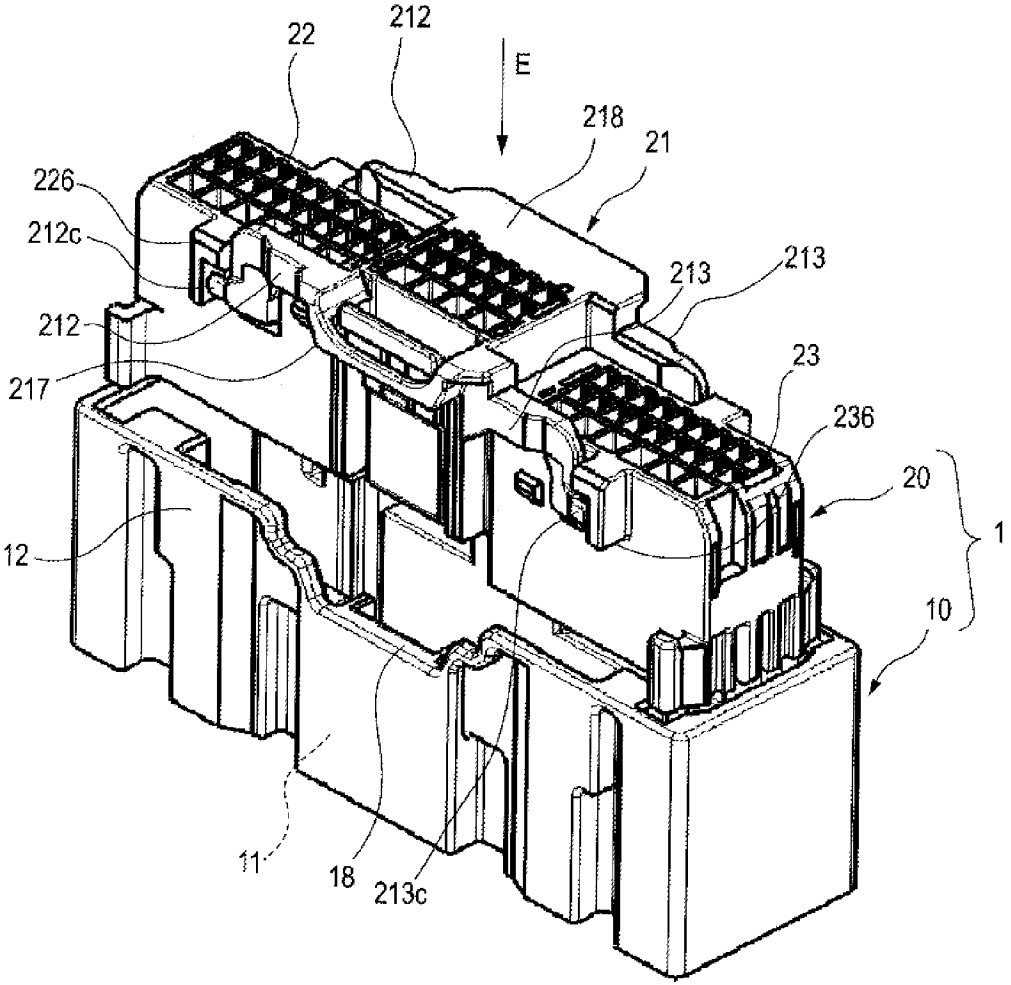
FIG. 1 is a perspective view of a first connector housing and a second connector housing of an insertion/extraction force reducing connector according to an embodiment of the present invention which are opposed to each other before fitting.
Figure 2:
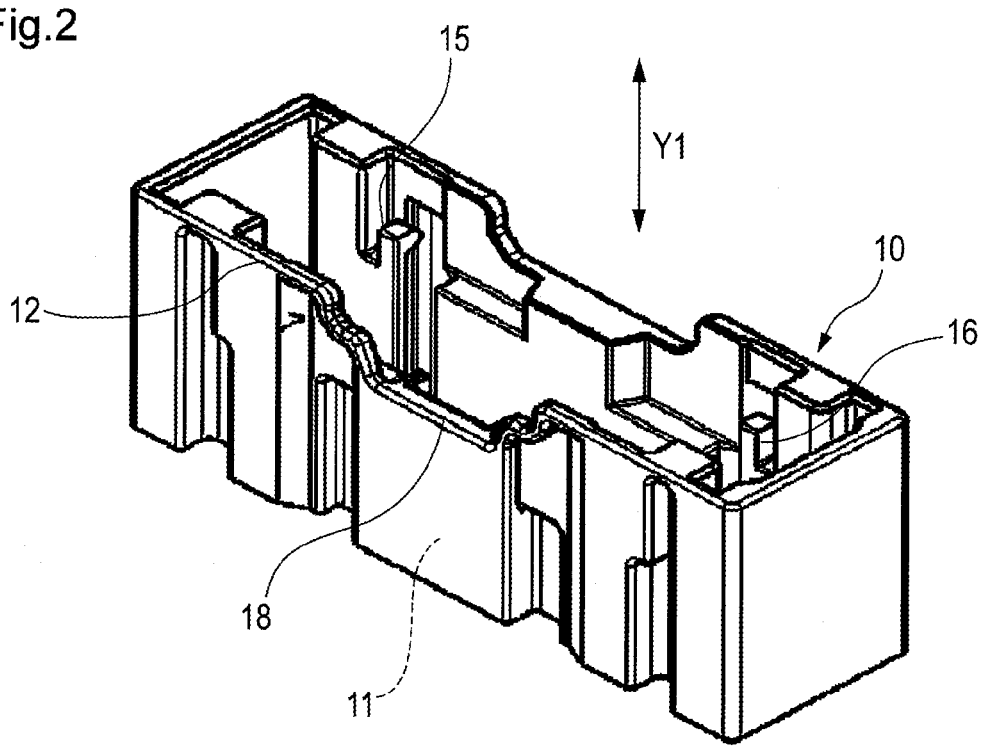
FIG. 2 is a perspective view of a first connector housing alone shown in FIG. 1.
Figure 3:
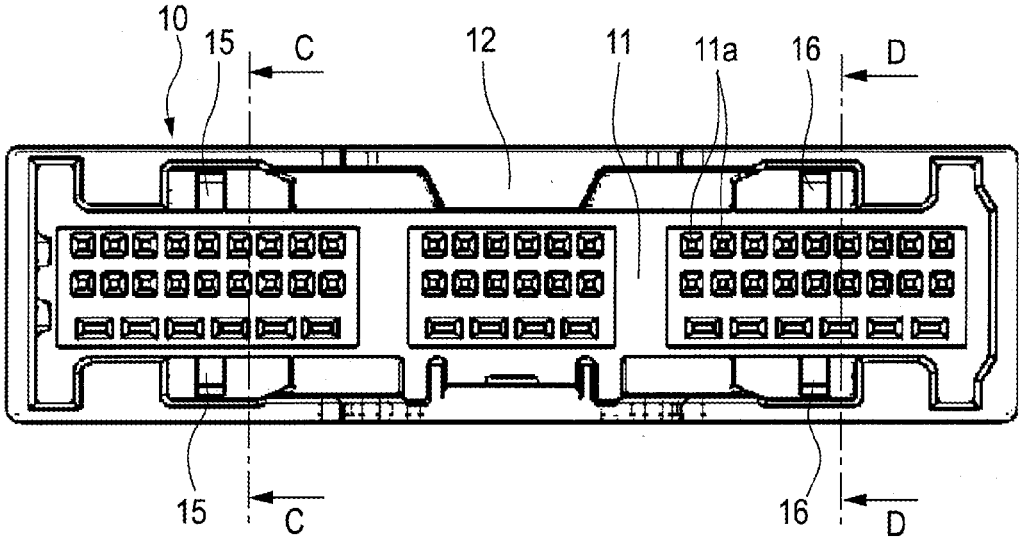
FIG. 3 is a plan view of the first connector housing shown in FIG. 2.
Figure 4:
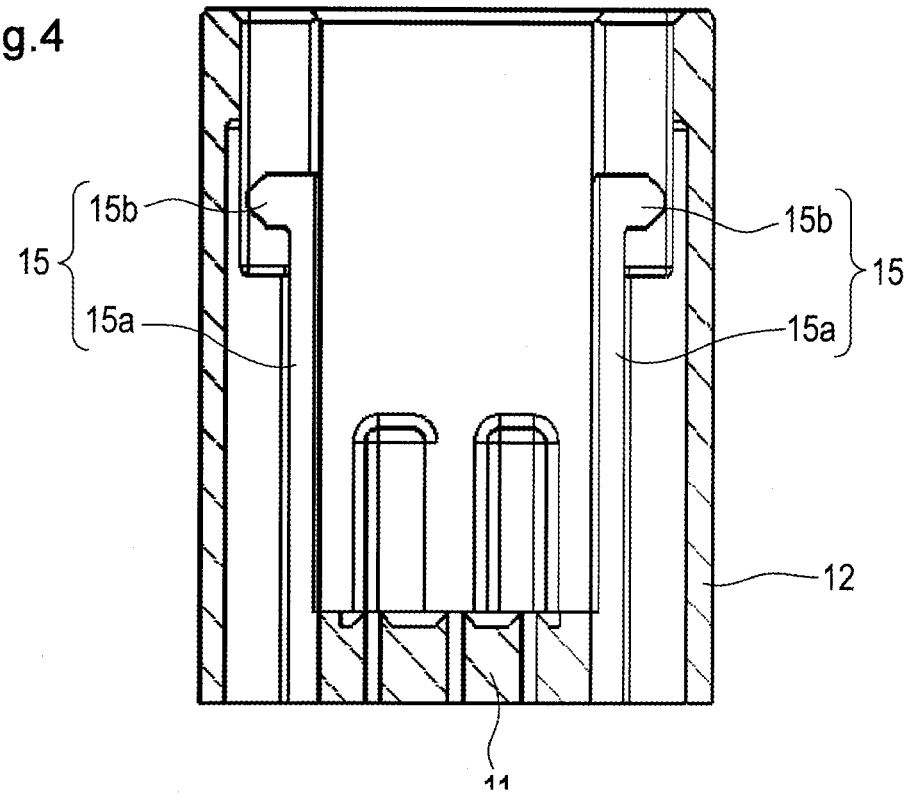
FIG. 4 is a sectional view taken along line C-C in FIG. 3.
Figure 5:
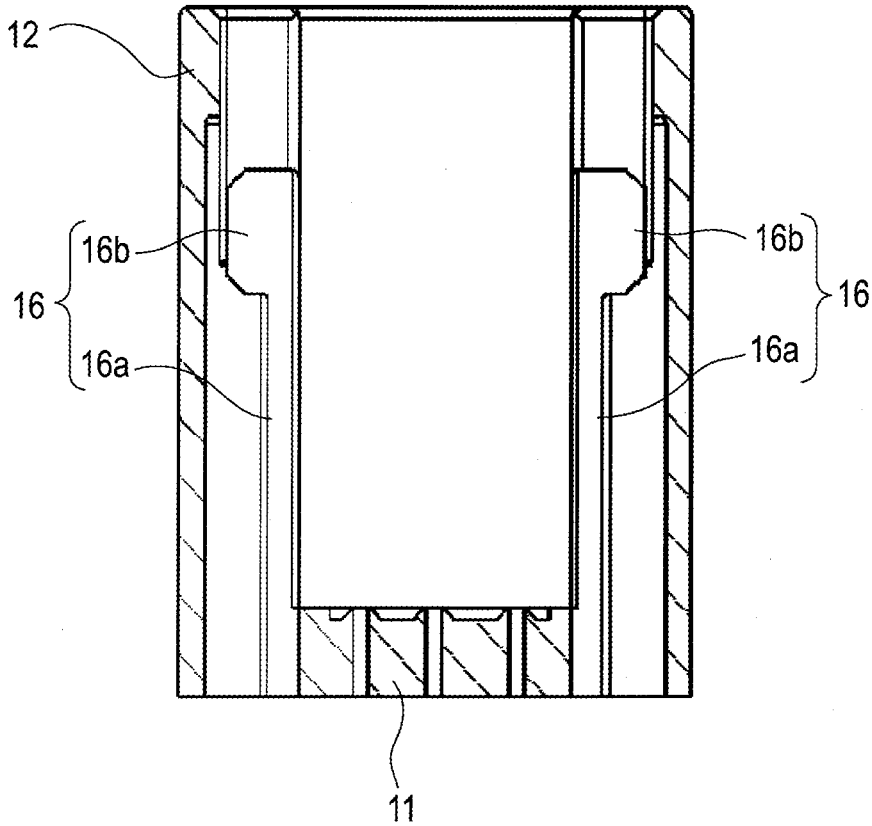
FIG. 5 is a sectional view taken along line D-D in FIG. 3.
Figure 6:
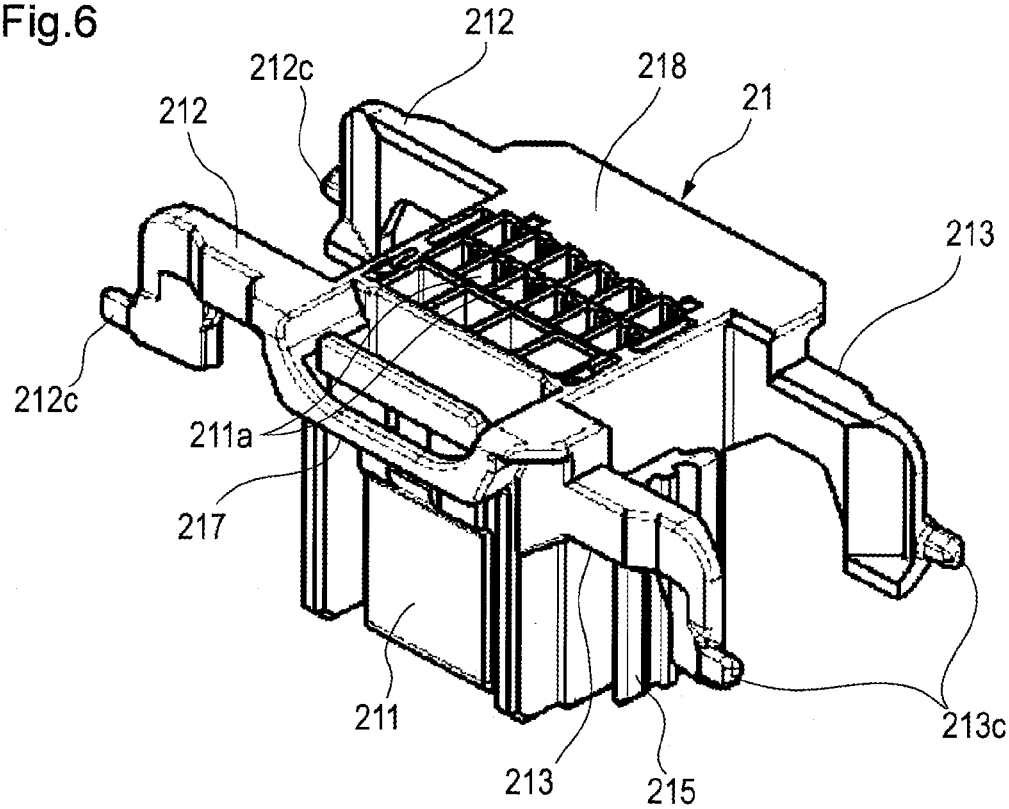
FIG. 6 is a perspective view of a first housing alone of the second connector housing shown in FIG. 1.
Figure 7:
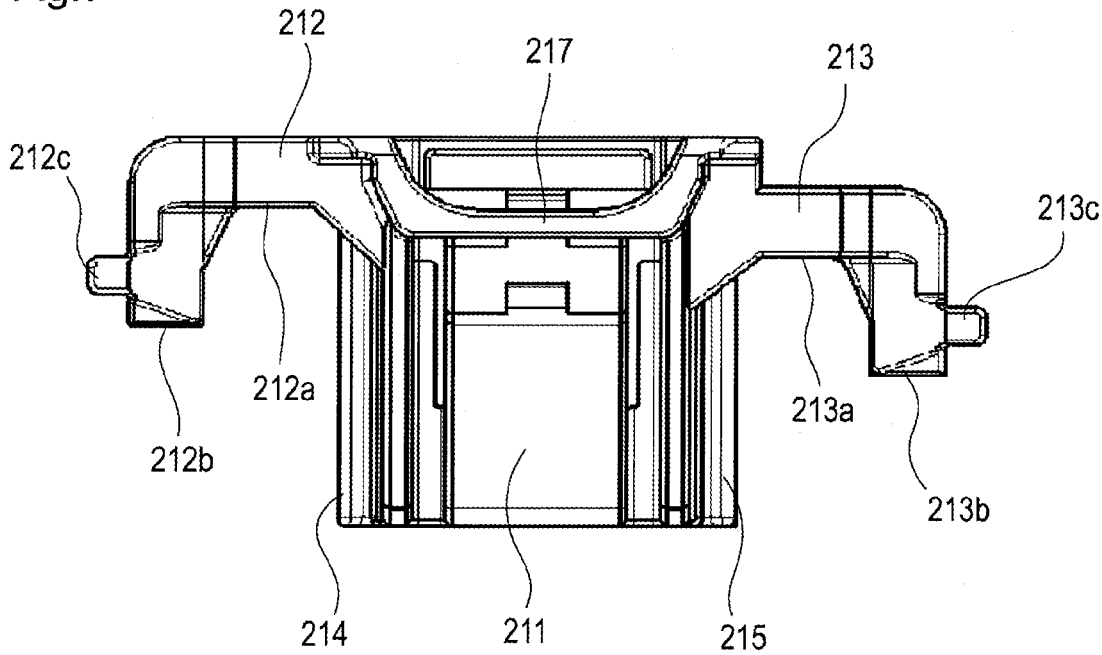
FIG. 7 is a front view of the first housing shown in FIG. 6.
Figure 8:
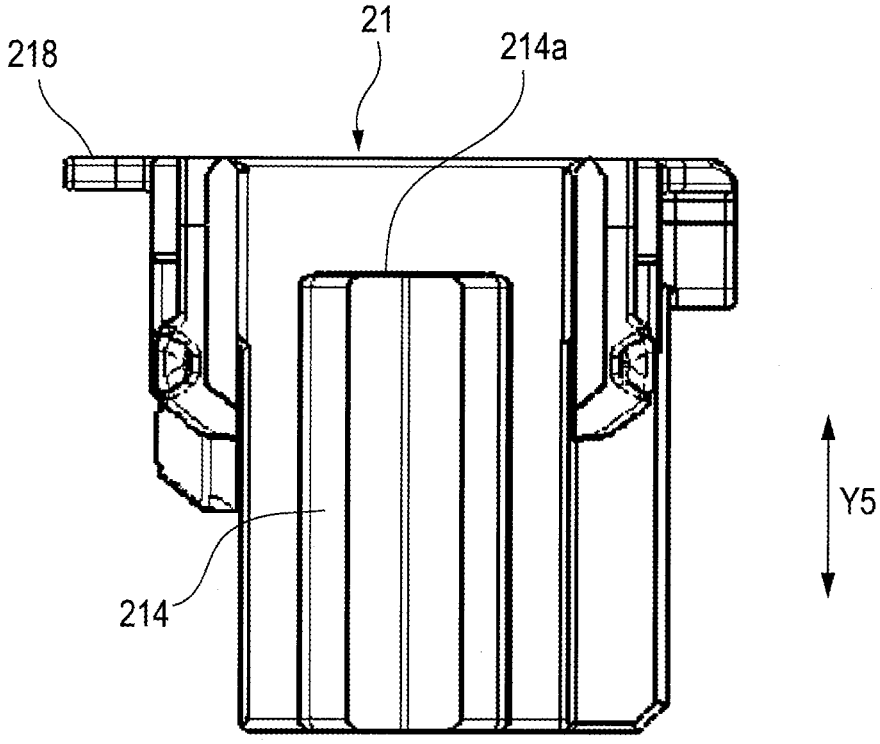
FIG. 8 is a left side view of the first housing shown in FIG. 7.
Figure 9:
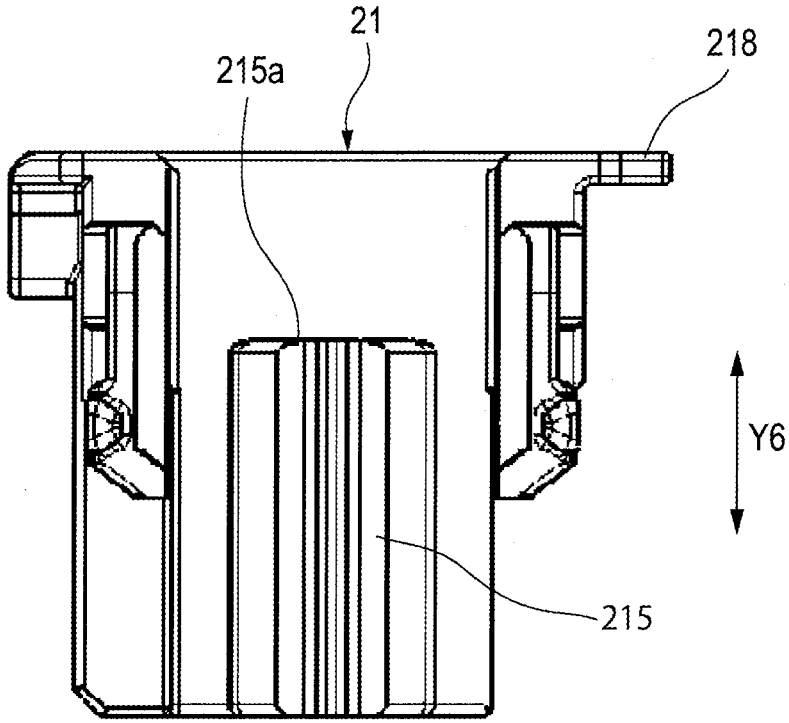
FIG. 9 is a right side view of the first housing shown in FIG. 7.
Figure 10:
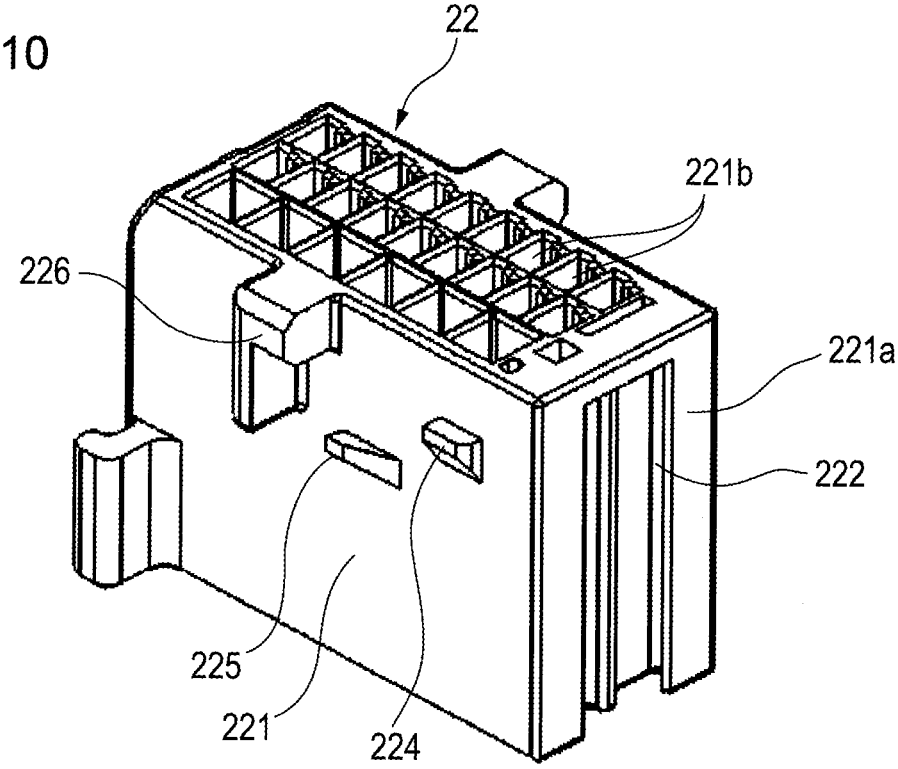
FIG. 10 is a perspective view of a second housing alone of the second connector housing shown in FIG. 1.
Figure 11:
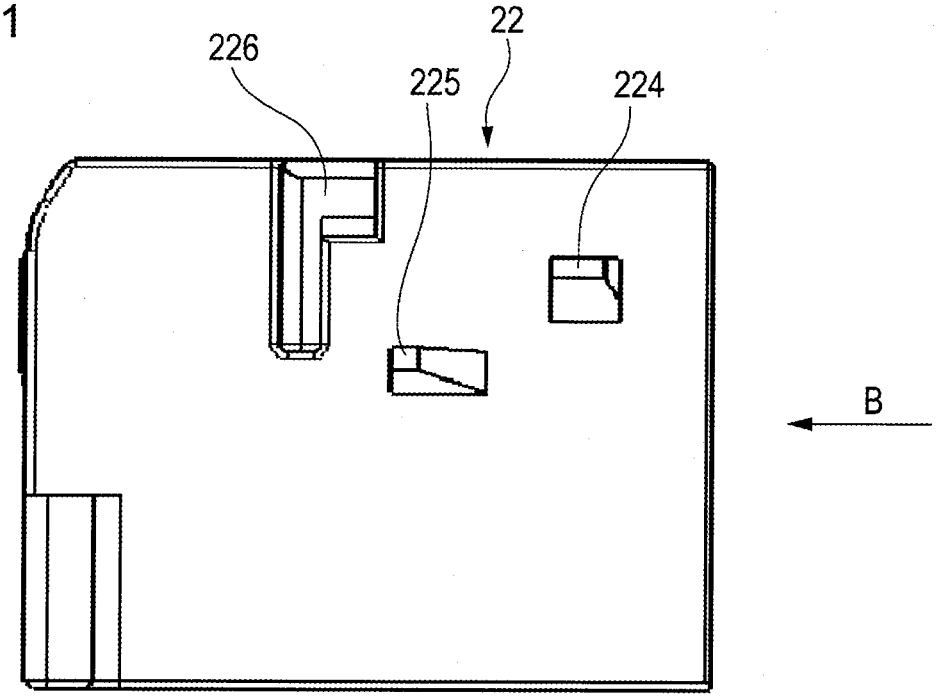
FIG. 11 is a front view of the second housing shown in FIG. 10.
Figure 12:
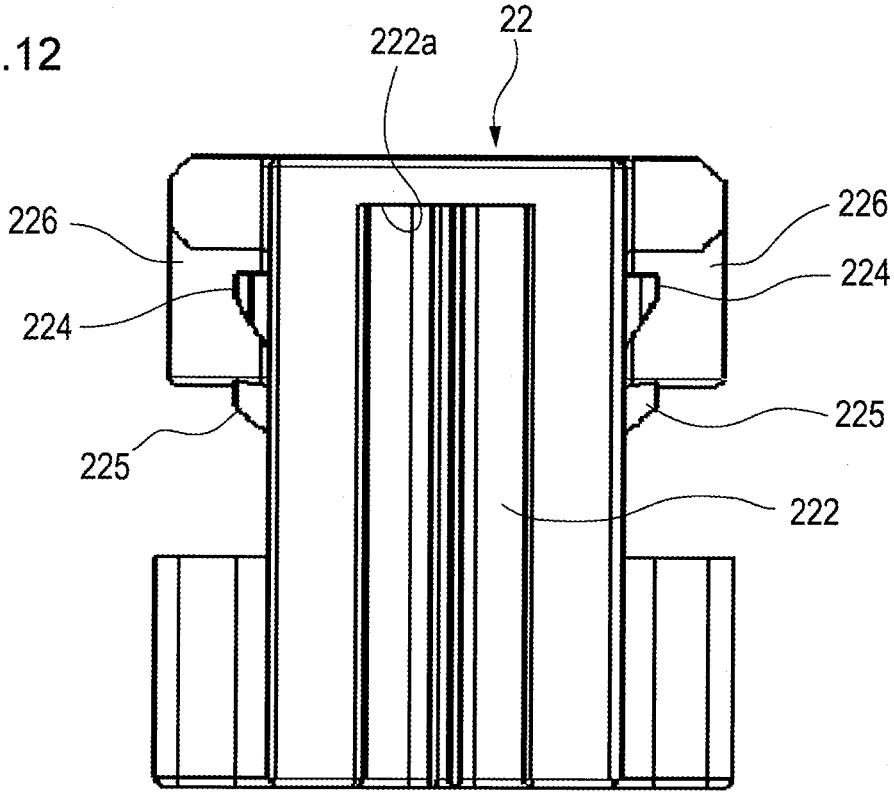
FIG. 12 is a side view as viewed from the direction indicated by arrow B in FIG. 11.
Figure 13:
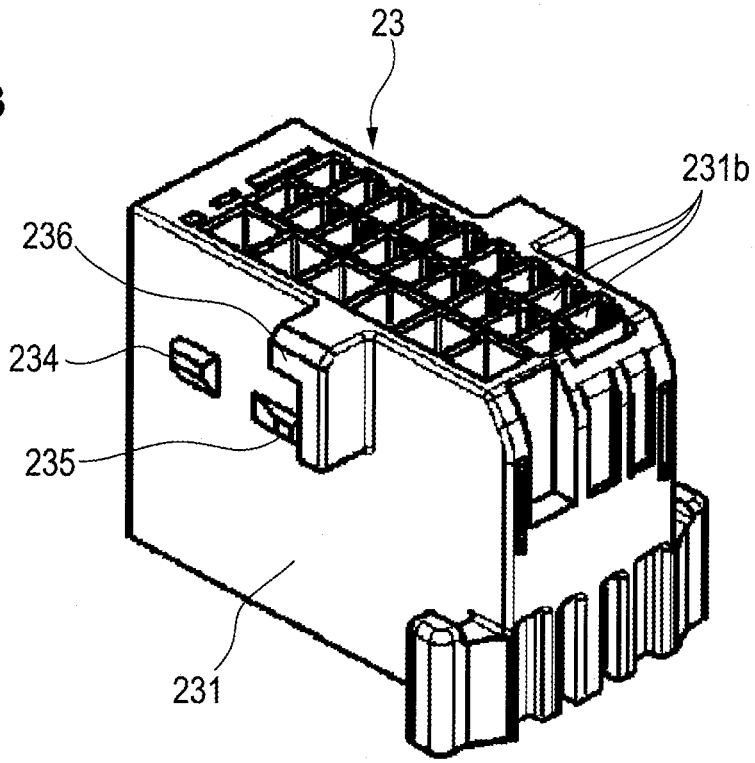
FIG. 13 is a perspective view of a third housing alone of the second connector housing shown in FIG. 1.
Figure 14:
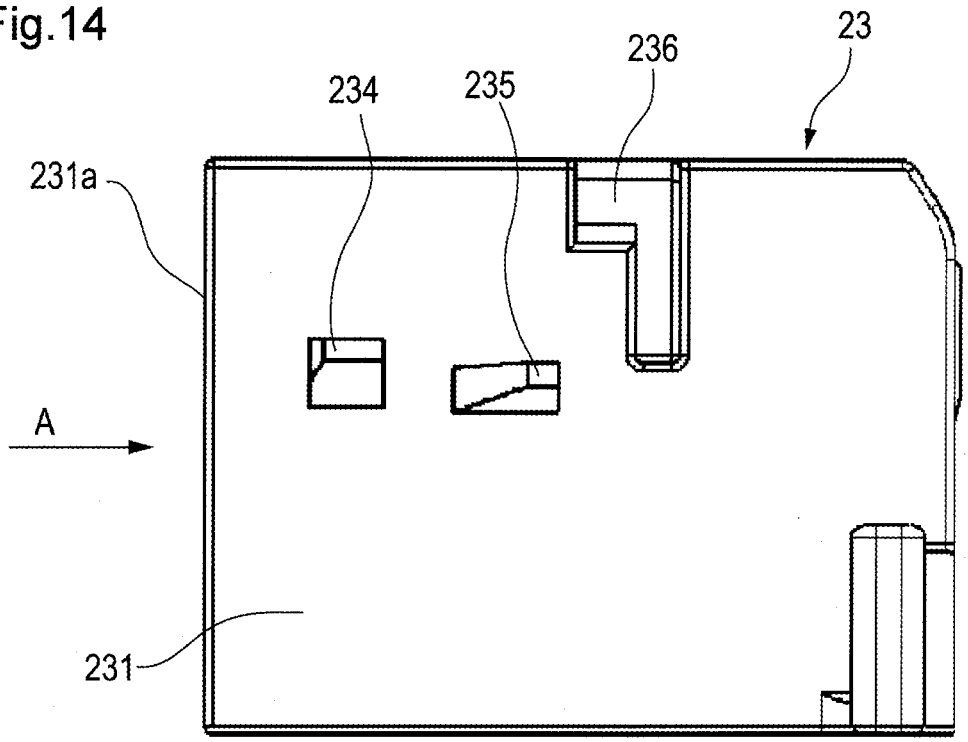
FIG. 14 is a front view of the third housing shown in FIG. 13.
Figure 15:
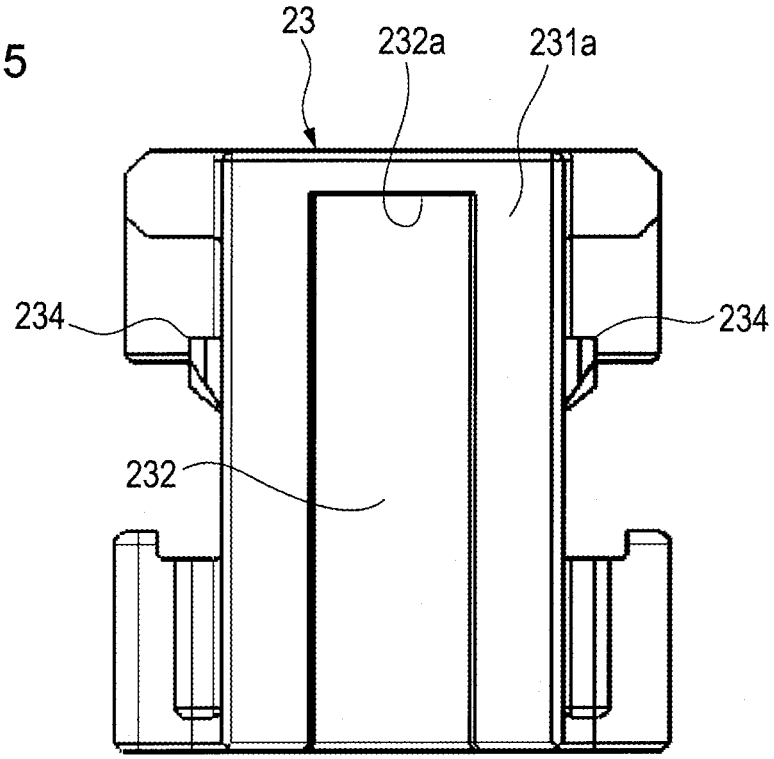
FIG. 15 is a side view as viewed from the direction indicated by arrow A in FIG. 14.
Figure 16:
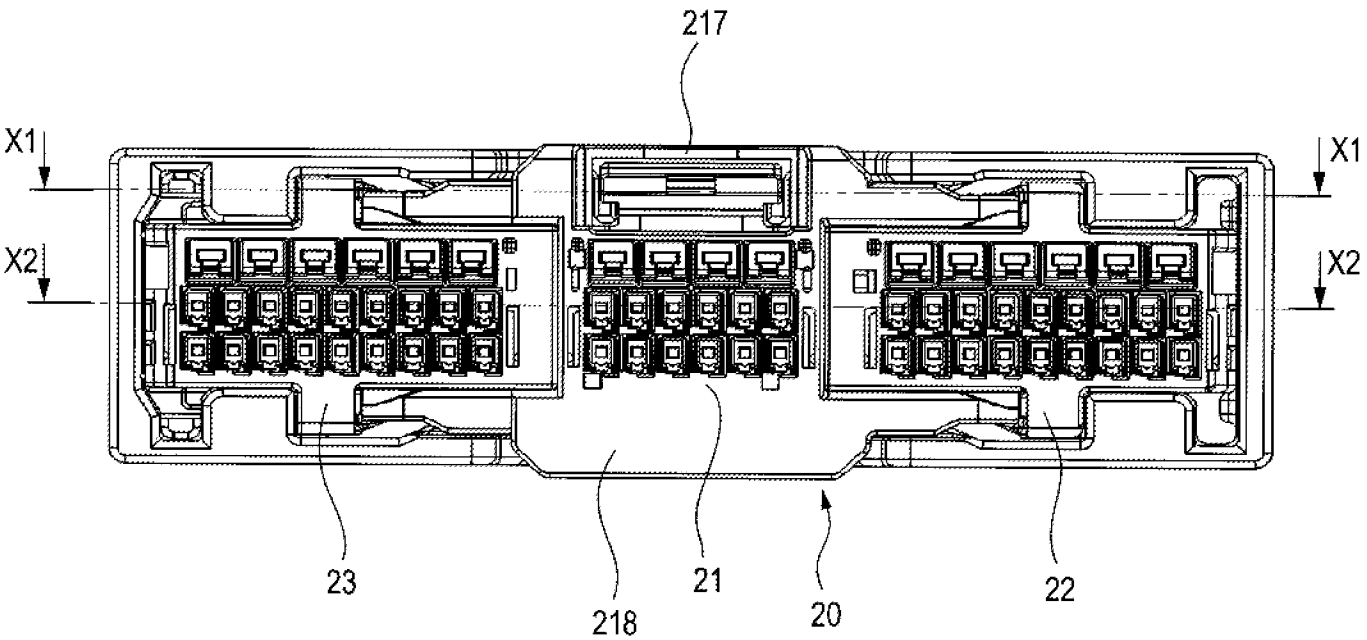
FIG. 16 is a top view as viewed from the direction indicated by arrow E in FIG. 1.
Figure 17:
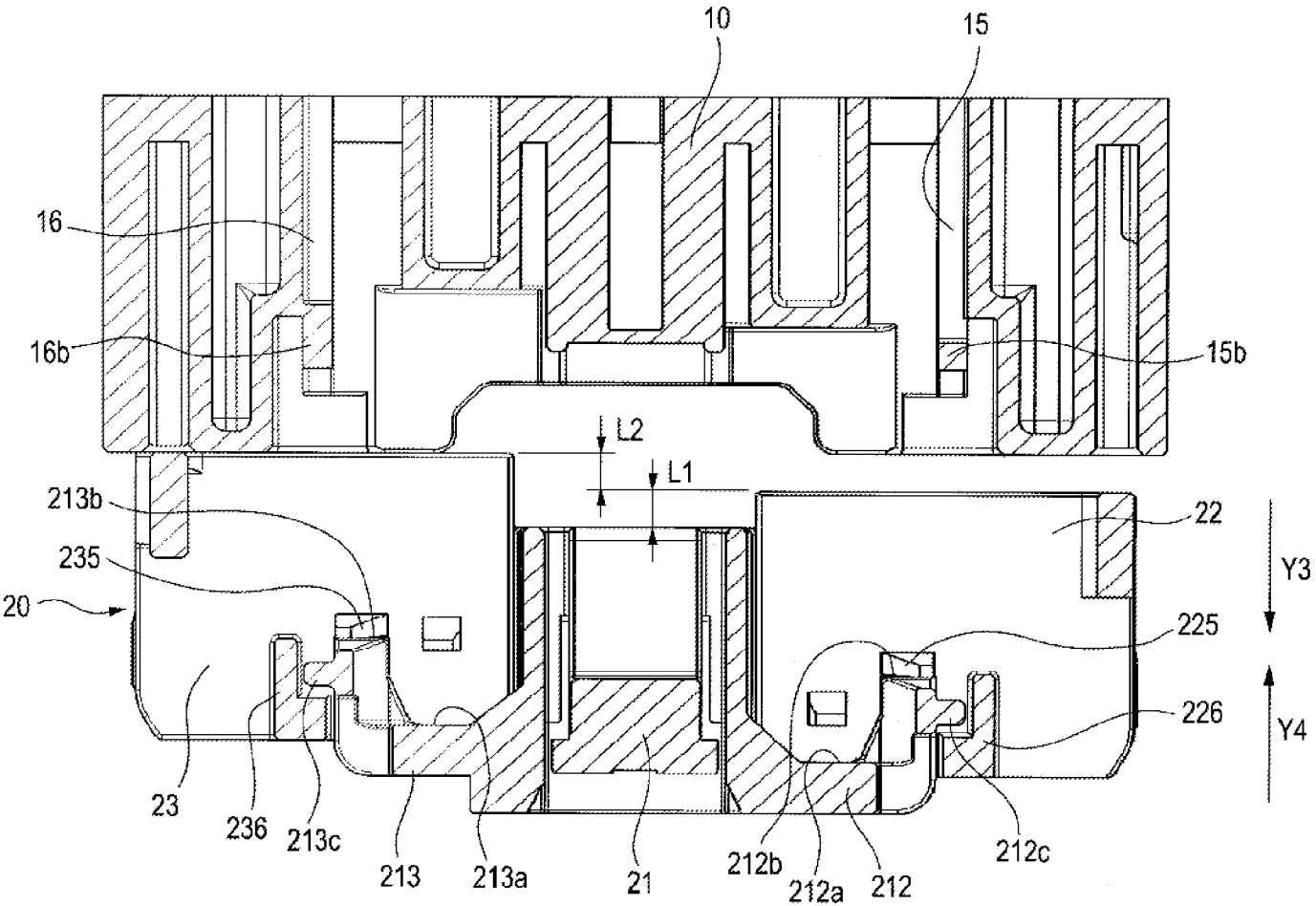
FIG. 17 is a sectional view taken along line X1-X1 in FIG. 16.
Figure 18:
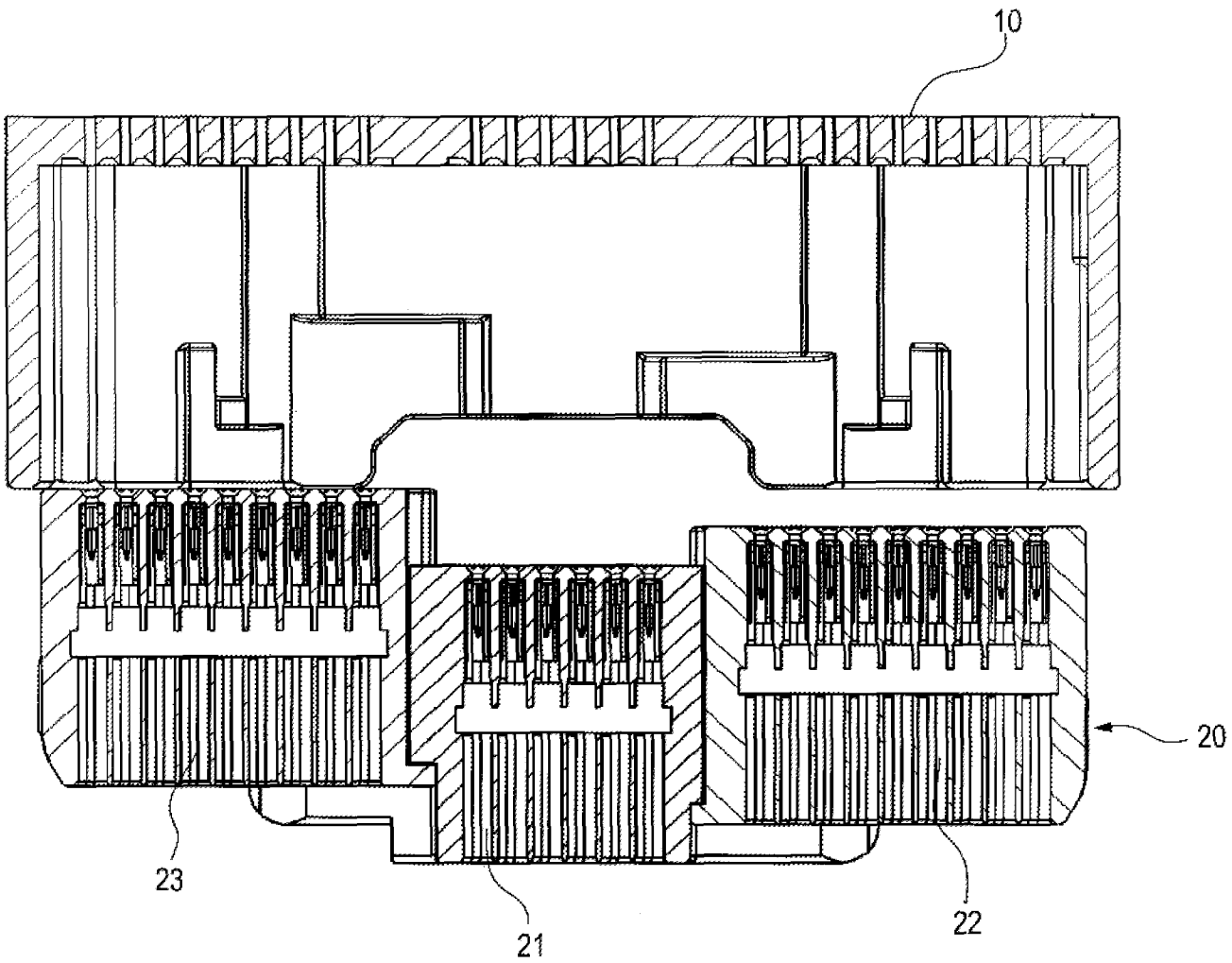
FIG. 18 is a sectional view taken along line X2-X2 in FIG. 16.

FIGS. 1-29 show the insertion/extraction force reducing connector according to the embodiment of the invention. FIG. 1 is a perspective view of a first connector housing and a second connector housing of the insertion/extraction force reducing connector according to the embodiment of the invention which are opposed to each other before fitting. FIG. 2 is a perspective view of a first connector housing alone shown in FIG. 1. FIG. 3 is a plan view of the first connector housing shown in FIG. 2. FIG. 4 is a sectional view taken along line C-C in FIG. 3. FIG. 5 is a sectional view taken along line D-D in FIG. 3. FIG. 6 is a perspective view of a first housing alone of the second connector housing shown in FIG. 1. FIG. 7 is a front view of the first housing shown in FIG. 6. FIG. 8 is a left side view of the first housing shown in FIG. 7. FIG. 9 is a right side view of the first housing shown in FIG. 7. FIG. 10 is a perspective view of a second housing alone of the second connector housing shown in FIG. 1. FIG. 11 is a front view of the second housing shown in FIG. 10. FIG. 12 is a side view as viewed from the direction indicated by arrow B in FIG. 11. FIG. 13 is a perspective view of a third housing alone of the second connector housing shown in FIG. 1. FIG. 14 is a front view of the third housing shown in FIG. 13. FIG. 15 is a side view as viewed from the direction indicated by arrow A in FIG. 14. FIG. 16 is a top view as viewed from the direction indicated by arrow E in FIG. 1. FIG. 17 is a sectional view taken along line X1-X1 in FIG. 16. FIG. 18 is a sectional view taken along line X2-X2 in FIG. 16.

Figure 19:
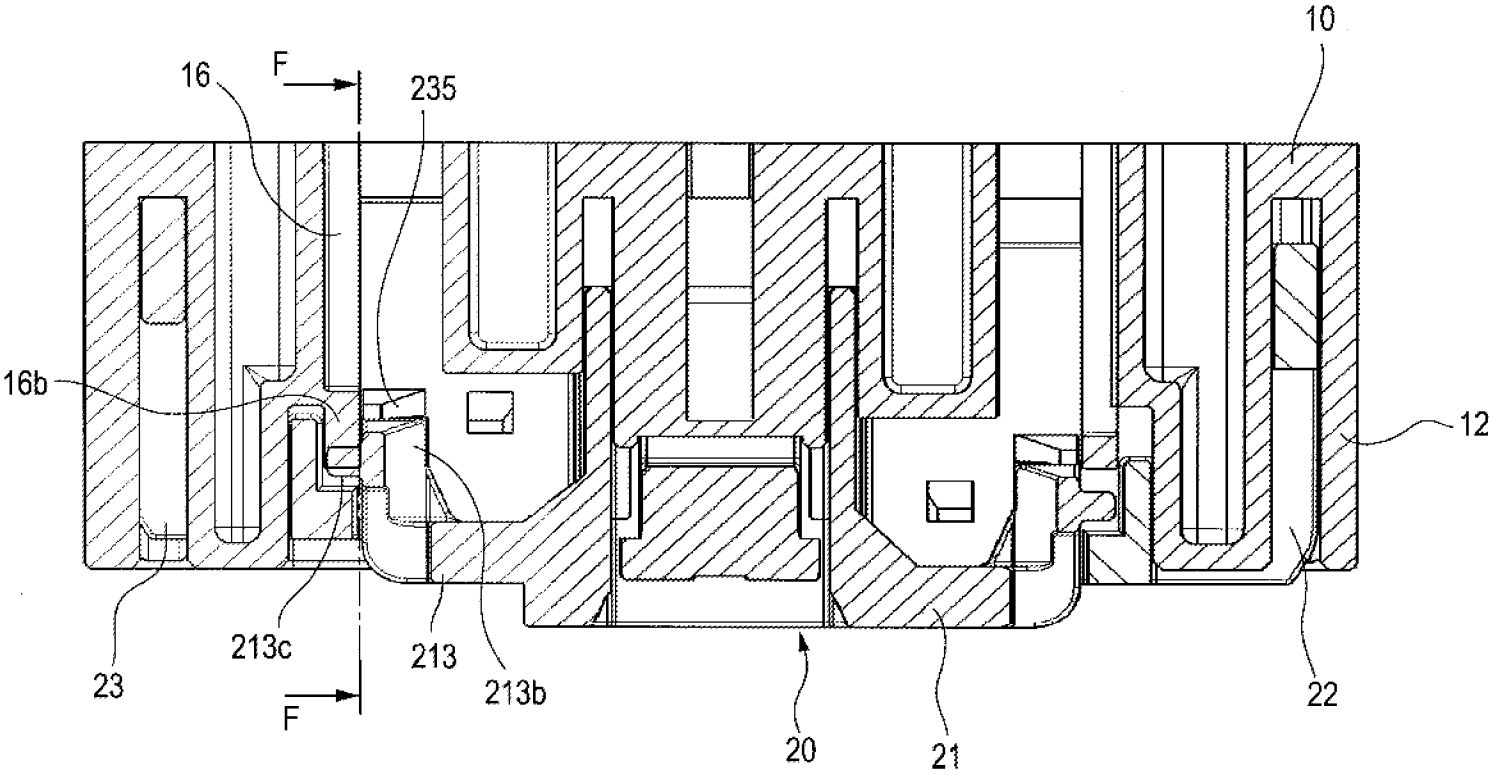
FIG. 19 is a sectional view showing positional relationships between the housings in a halfway state of fitting of the second connector housing into the first connector housing in which fitting of the third housing into the first connector housing is completed and the second housing and the first housing are in the process of fitting.
Figure 20:
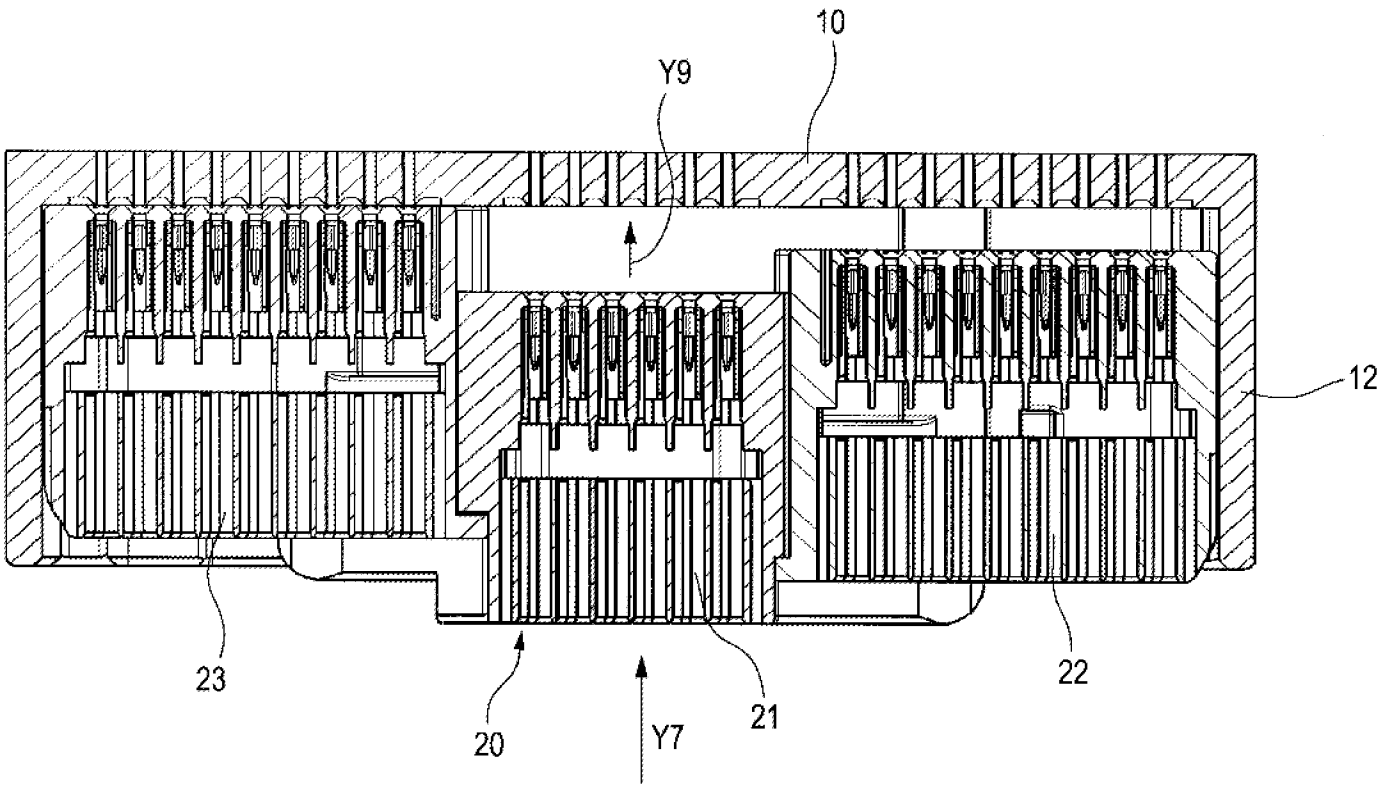
FIG. 20 is a sectional view showing positions of the sets of second terminal metal fittings housed in the respective housings in the halfway state of fitting shown in FIG. 19.
Figure 21:
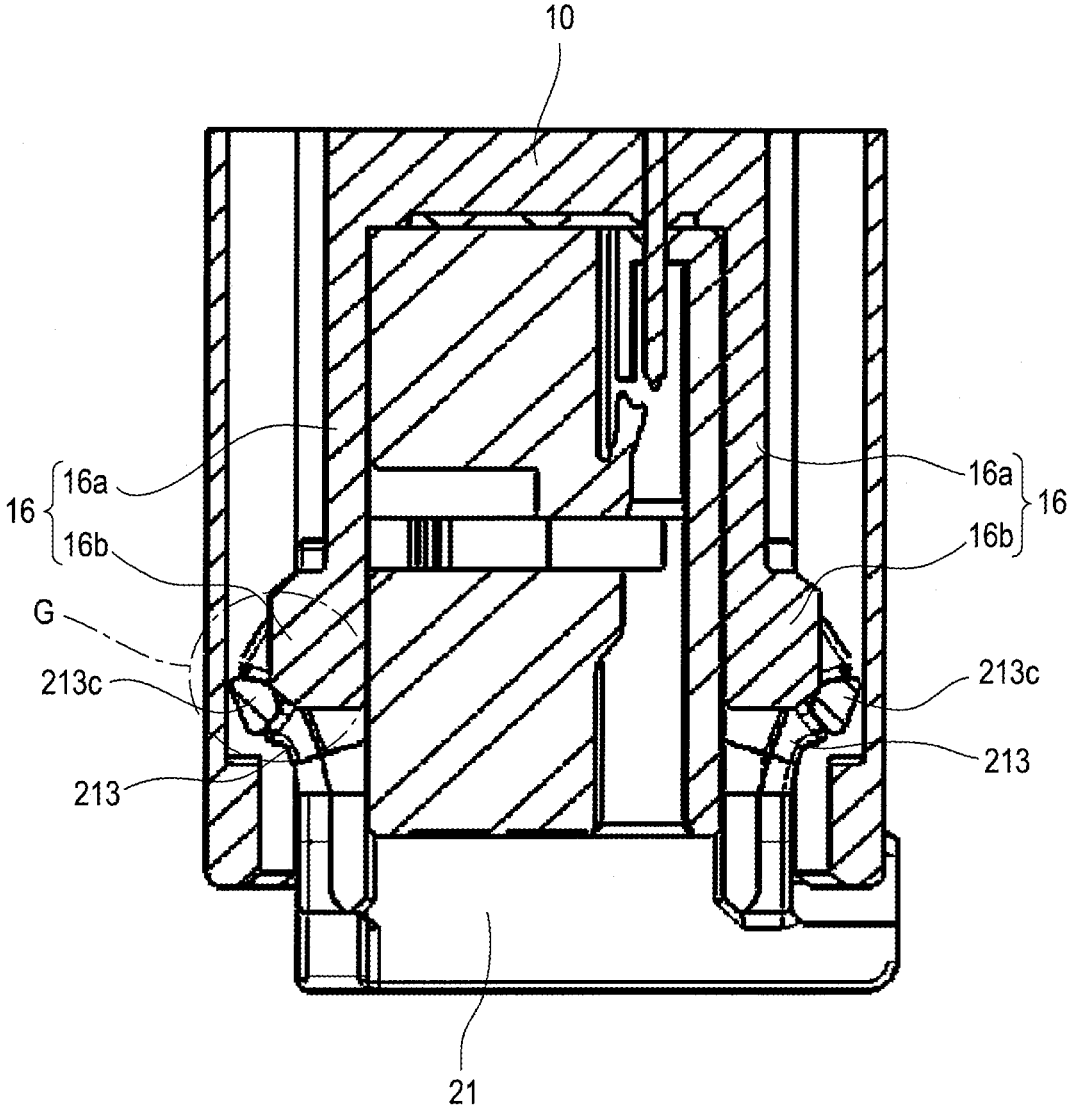
FIG. 21 is a sectional view taken along line F-F in FIG. 19.
Figure 22:
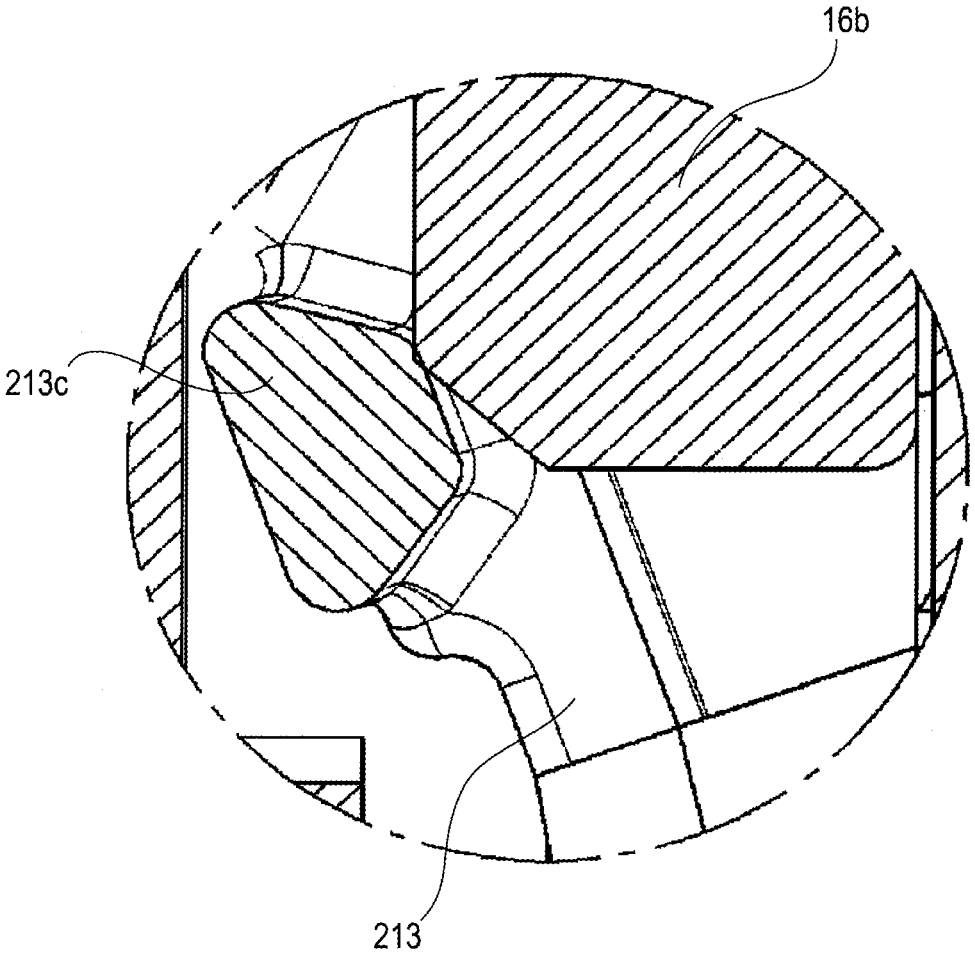
FIG. 22 is an enlarged view of part G of FIG. 21.
Figure 23:
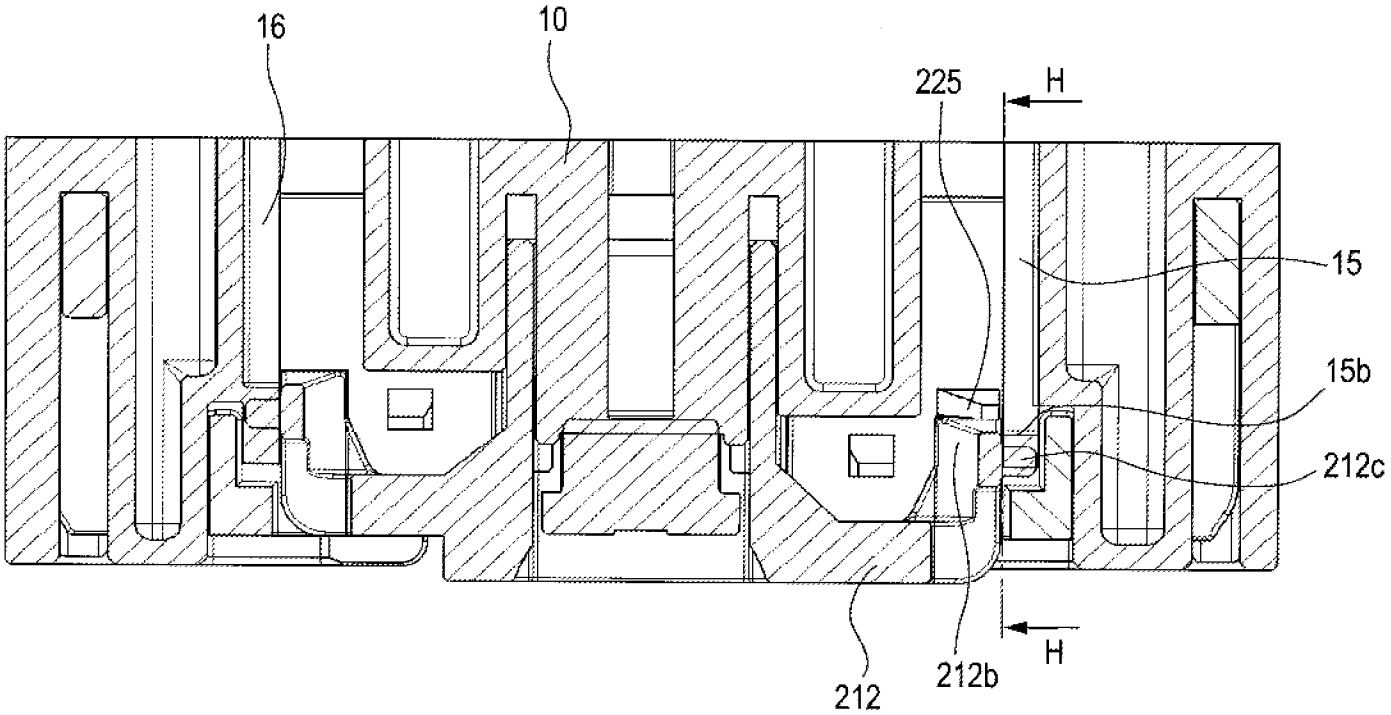
FIG. 23 is a sectional view is a sectional view showing positional relationships between the housings in a halfway state of fitting of the second connector housing into the first connector housing in which fitting of the third housing and the second housing into the first connector housing is completed and the first housing is in the process of fitting.
Figure 24:
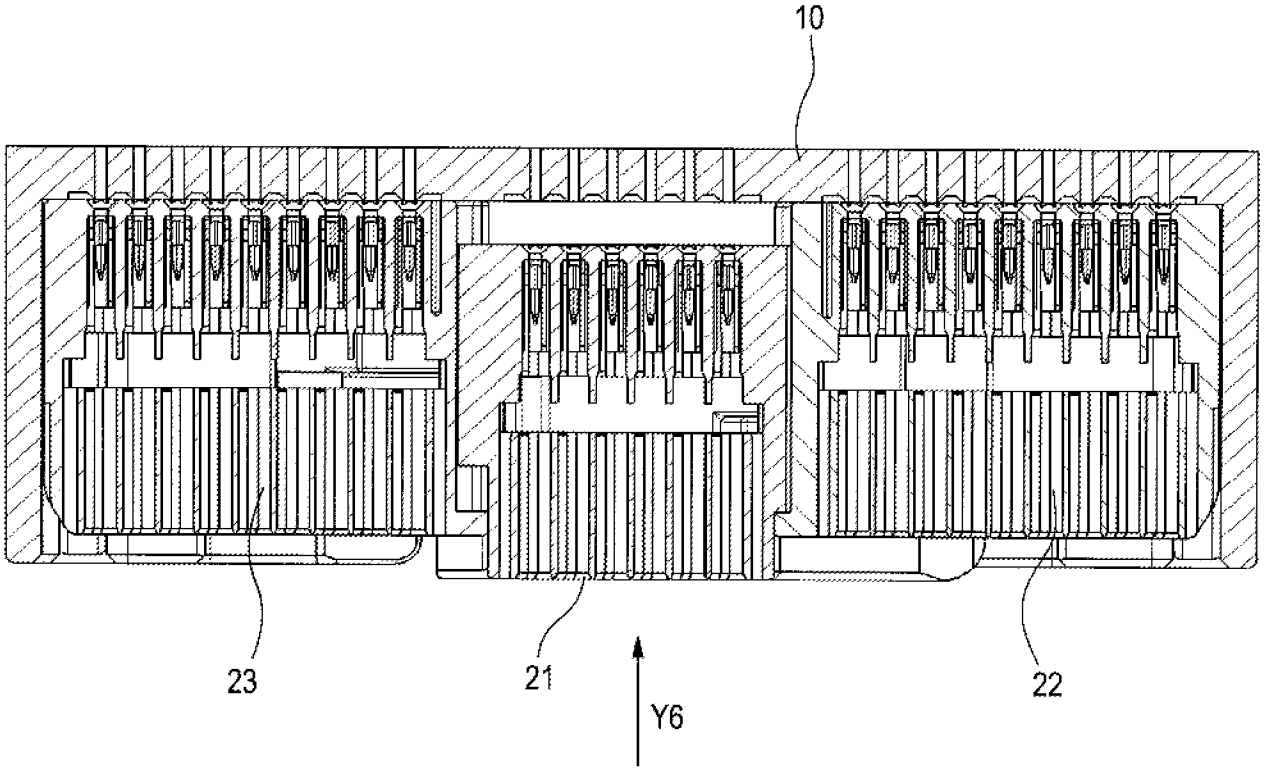
FIG. 24 is a sectional view showing positions of the sets of second terminal metal fittings housed in the respective housings in the halfway state of fitting shown in FIG. 23.
Figure 25:
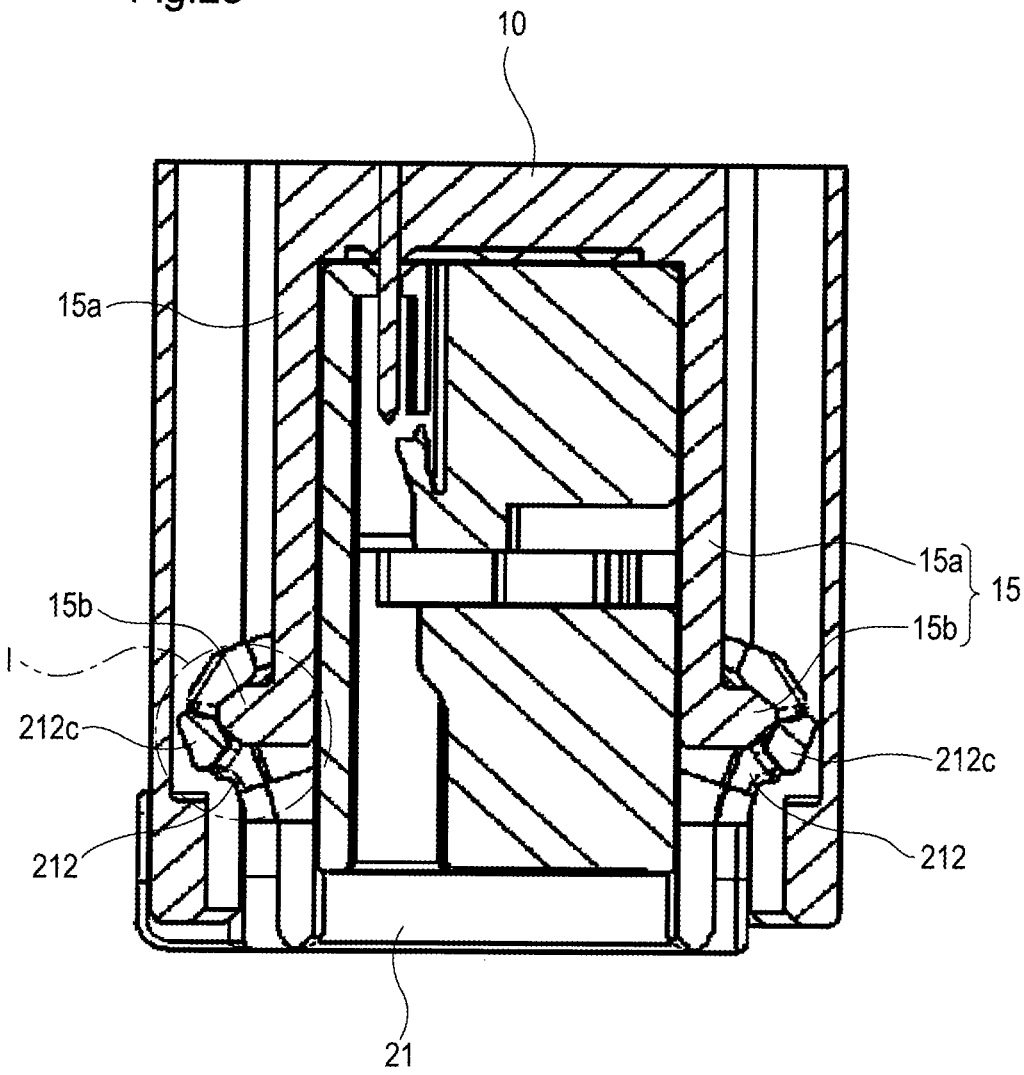
FIG. 25 is a sectional view taken along line H-H in FIG. 23.
Figure 26:
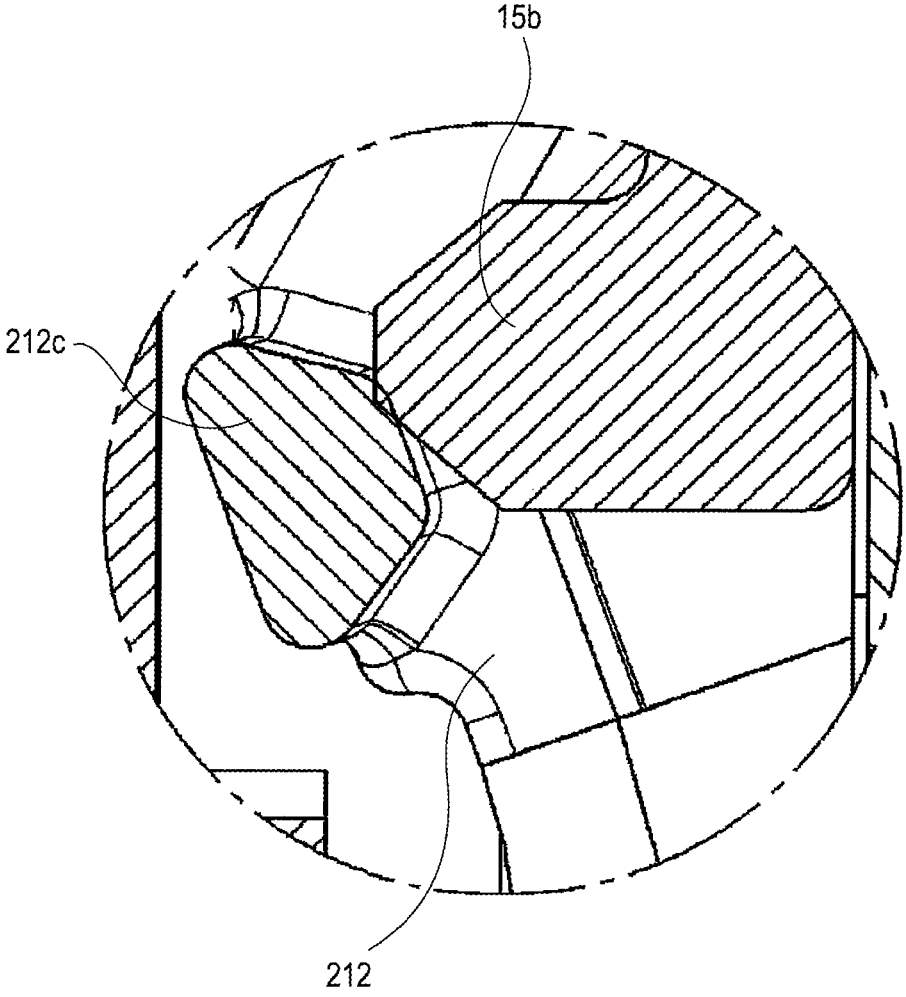
FIG. 26 is an enlarged view of part I of FIG. 25.

FIG. 19 is a sectional view showing positional relationships between the housings in a halfway state of fitting of the second connector housing into the first connector housing in which fitting of the third housing into the first connector housing is completed and the second housing and the first housing are in the process of fitting. FIG. 20 is a sectional view showing positions of the sets of second terminal metal fittings housed in the respective housings in the halfway state of fitting shown in FIG. 19. FIG. 21 is a sectional view taken along line F-F in FIG. 19. FIG. 22 is an enlarged view of part G of FIG. 21. FIG. 23 is a sectional view is a sectional view showing positional relationships between the housings in a halfway state of fitting of the second connector housing into the first connector housing in which fitting of the third housing and the second housing into the first connector housing is completed and the first housing is in the process of fitting. FIG. 24 is a sectional view showing positions of the sets of second terminal metal fittings housed in the respective housings in the halfway state of fitting shown in FIG. 23. FIG. 25 is a sectional view taken along line H-H in FIG. 23. FIG. 26 is an enlarged view of part I of FIG. 25.

Figure 27:
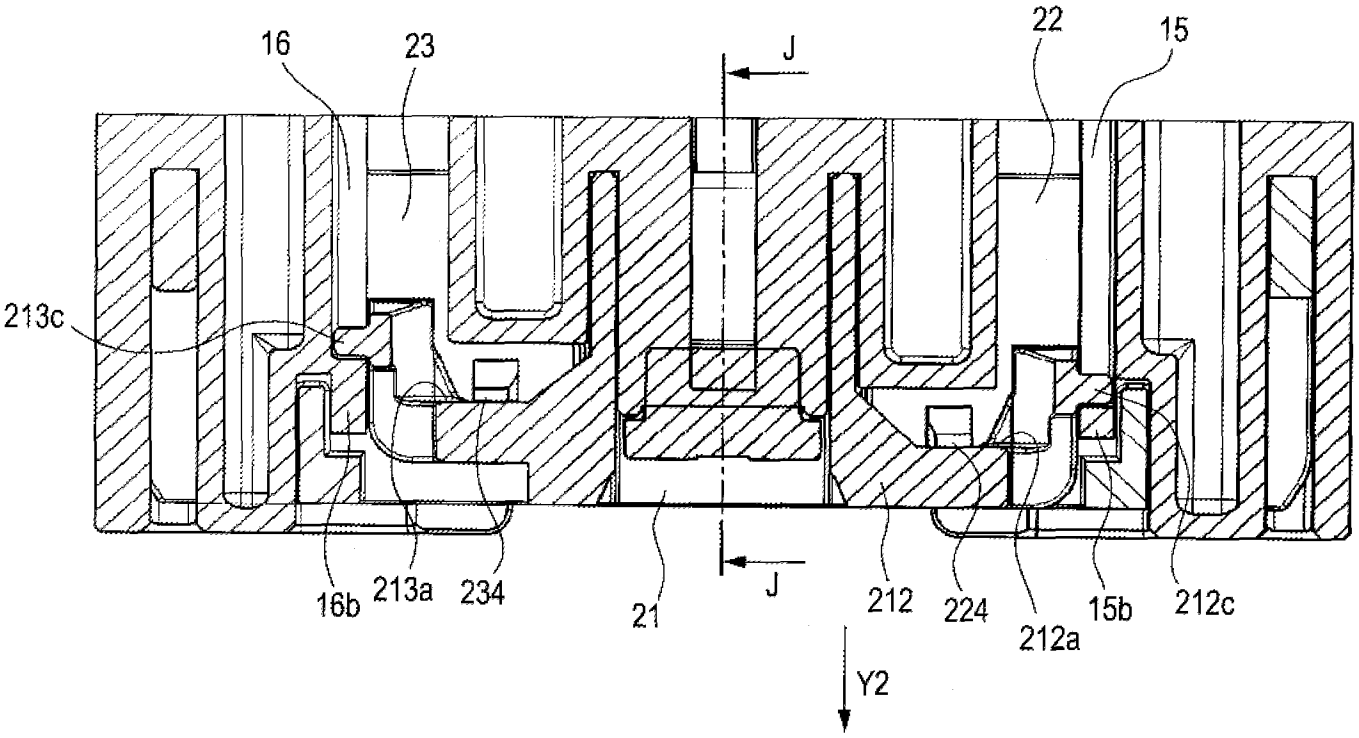
FIG. 27 is a sectional view is a sectional view showing positional relationships between the housings constituting the second connector housing and the first connector housing in a state that the manipulation for fitting the second connector housing into the first connector housing has completed.
Figure 28:
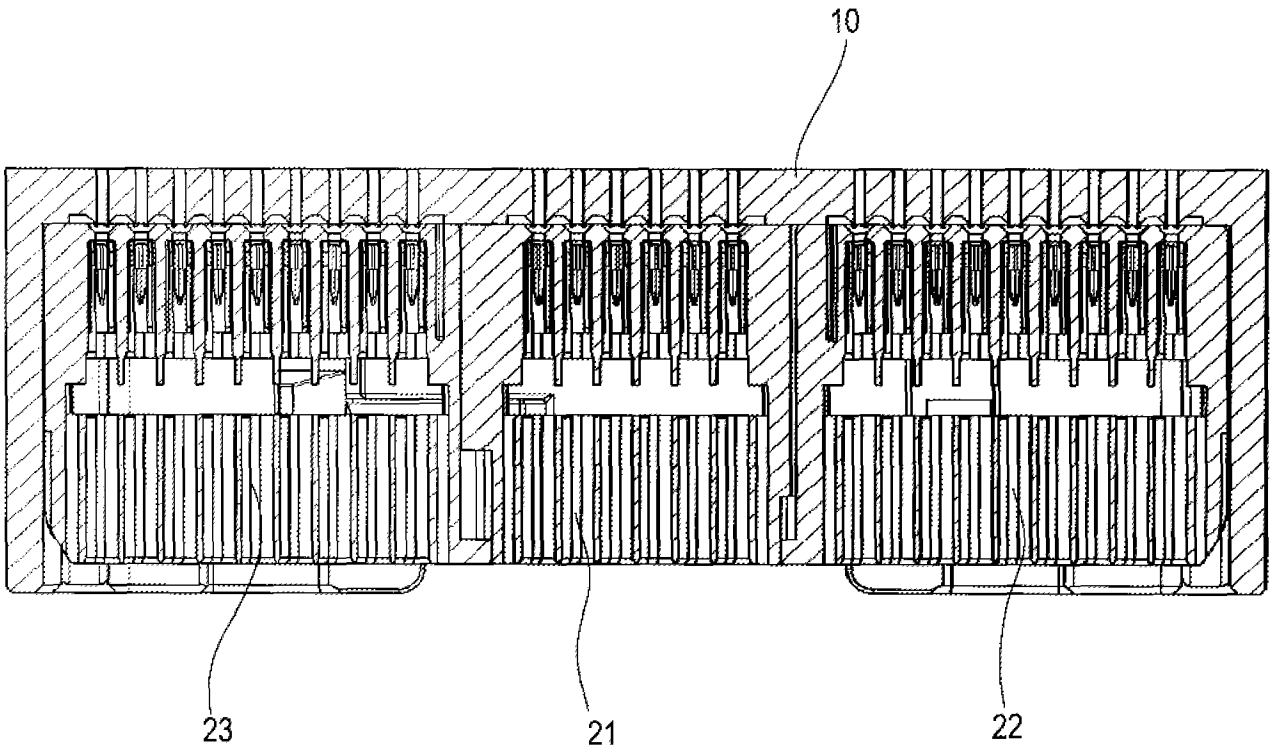
FIG. 28 is a sectional view showing positions of the sets of second terminal metal fittings housed in the respective housings in the fitting-completed state shown in FIG. 27.
Figure 29:
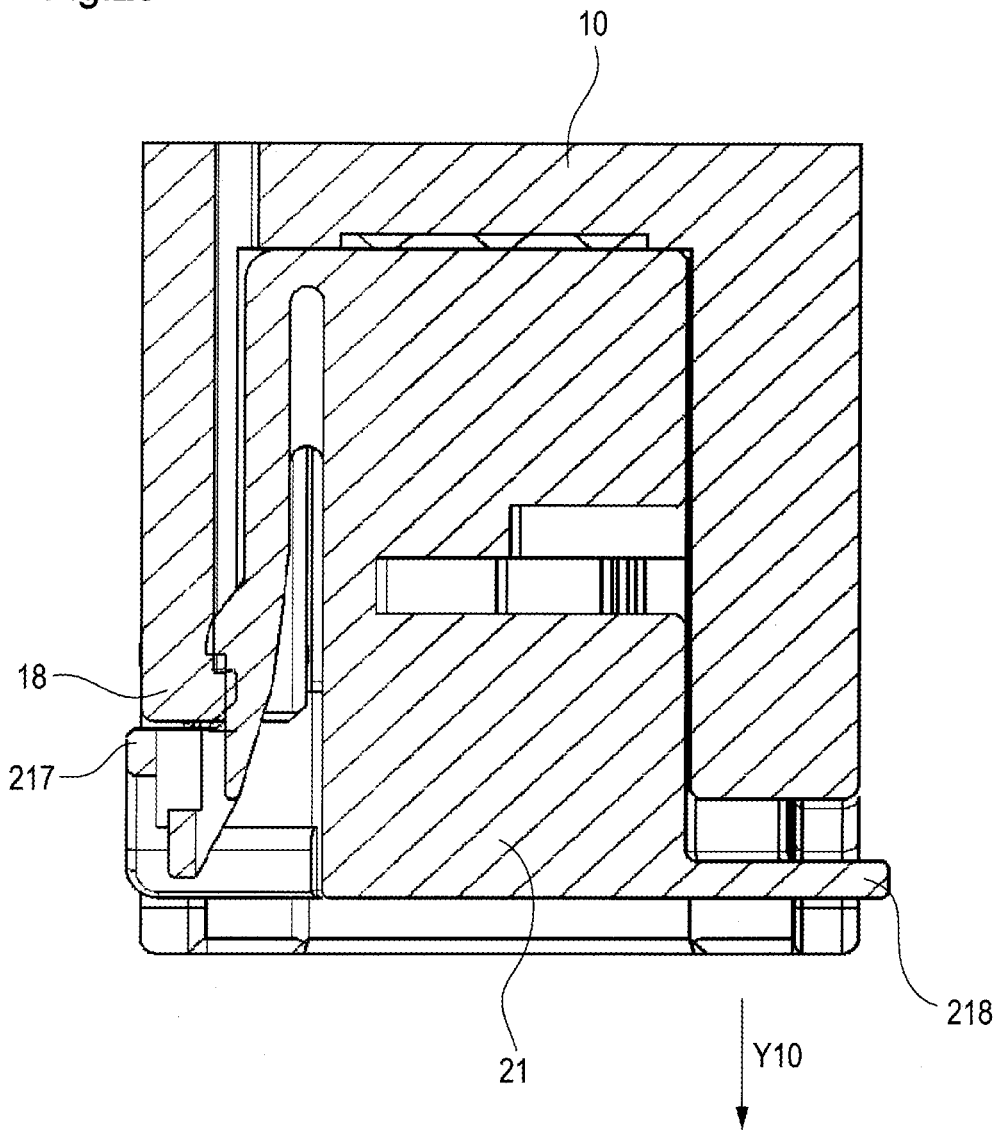
FIG. 29 is a sectional view taken along line J-J in FIG. 27.
Figure 30:
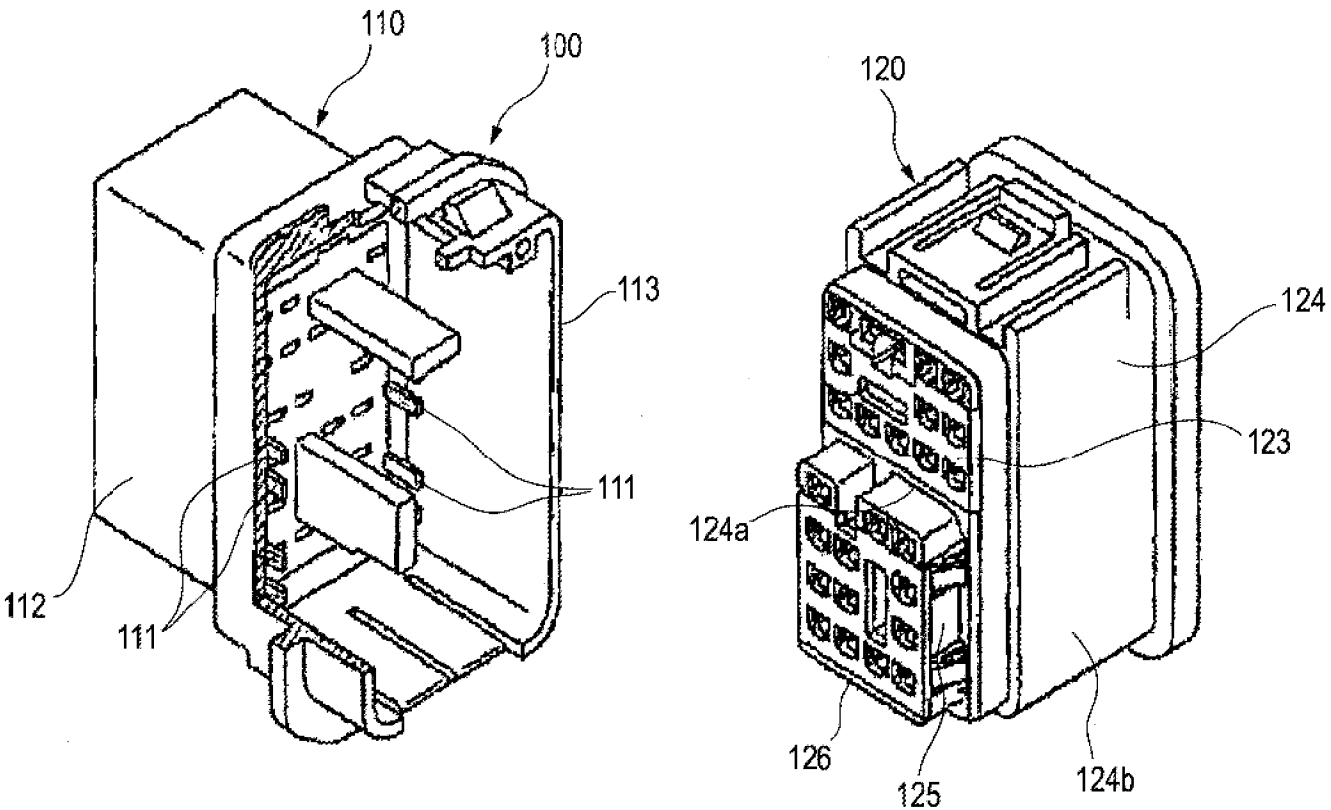
Fig. 30 PRIOR ART
FIG. 30 is an exploded perspective view of a conventional insertion/extraction force reducing connector.

FIG. 27 is a sectional view is a sectional view showing positional relationships between the housings constituting the second connector housing and the first connector housing in a state that the manipulation for fitting the second connector housing into the first connector housing has completed. FIG. 28 is a sectional view showing positions of the sets of second terminal metal fittings housed in the respective housings in the fitting-completed state shown in FIG. 27. FIG. 29 is a sectional view taken along line J-J in FIG. 27.

As shown in FIG. 1, the insertion/extraction force reducing connector 1 according to the embodiment is composed of a first connector housing 10 and a second connector housing 20 to be connected to the former.

As shown in FIGS. 2 and 3, the first connector housing 10 is equipped with a first terminal holding part 11 and a hood part 12. The first terminal holding part 11 holds plural first terminal metal fittings (not shown) by plural terminal support portions 11*a* (see FIG. 3).

The hood part 12 is a rectangular-cylinder-shaped part which extends from a front outer circumferential portion of the first terminal holding part 11 cylindrically in the connector housing fitting direction (indicated by arrow Y1 in FIG. 2). The hood part 12 is to be fitted with and connected to the second connector housing 20 (mating housing).

The hood part 12 is formed with second temporary lock cancellation projections 15 and third temporary lock cancellation projections 16 inside. As shown in FIG. 4, the second temporary lock cancellation projections 15 are formed on confronting inner side surfaces of the hood part 12, respectively. As shown in FIG. 4, each second temporary lock cancellation projection 15 has a spring piece 15*a* which projects perpendicularly from the first terminal holding part 11 and a projected tip 15*b* which projects from the tip of the spring piece 15*a*. The second temporary lock cancellation projections 15 are projections for canceling a temporary lock state of a second housing of the second connector housing 20 (described later).

As shown in FIG. 5, the third temporary lock cancellation projections 16 are formed on confronting inner side surfaces of the hood part 12, respectively. As shown in FIG. 5, each third temporary lock cancellation projection 16 has a spring piece 16*a* which projects perpendicularly from the first terminal holding part 11 and a projected tip 16*b* which projects from the tip of the spring piece 16*a*. The third temporary lock cancellation projections 16 are projections for canceling a temporary lock state of a third housing of the second connector housing 20 (described later).

The second connector housing 20 holds plural second terminal metal fittings (not shown) to be fitted into or with the respective first terminal metal fittings which are held by the first connector housing 10. When the second connector housing 20 is fitted into the hood part 12 of the first connector housing 10, the second terminal metal fittings are fitted into or with the respective first terminal metal fittings.

In the second connector housing 20 used in the embodiment, the second terminal metal fittings held by it are divided into three groups, that is, a first group, a second group, and a third group. When the connector housing 20 is inserted into or pulled out of the first connector housing 10, the sets of second terminal metal fittings belonging to the respective groups are engaged with or pulled out of the associated sets of first terminal metal fittings of the first connector housing 10 in order on a group-by-group basis. That is to say, the sets of second terminal metal fittings belonging to the respective groups are engaged with or pulled out of the associated sets of first terminal metal fittings of the first connector housing 10 with timing of the engagement or pulling-out delayed.

More specifically, the second connector housing 20 used in the embodiment is equipped with a first housing 21, a second housing 22, and a third housing 23. The first housing 21 is a housing which holds the second terminal metal fittings belonging to the first group. The first housing 21 is to be fitted into the hood part 12.

As shown in FIGS. 6 and 7, the first housing 21 has a terminal housing/holding portion 211, a pair of first support arms 212 which are integrally formed with the terminal housing/holding portion 211 and are located on one side (left side) of it, a pair of second support arms 213 which are integrally formed with the terminal housing/holding portion 211 and are located on the other side (right side) of it, a first slide fitting portion 214, a second slide fitting portion 215, and a lock portion 217 and a manipulation portion 218 which project from a base portion of the terminal housing/holding portion 211.

As shown in FIG. 6, the terminal housing/holding portion 211 has plural terminal housing holes 211*a* which are through-holes which house and hold the respective second terminal metal fittings belonging to the first group.

The pair of first support arms 212 project from the terminal housing/holding portion 211 on its left side. The first support arms 212 cooperate with the first slide fitting portion 214 to connect the second housing 22 to the terminal housing/holding portion 211 so that the former is located adjacent to the latter on the left side of the latter. As shown in FIG. 7, as a means for positioning the second housing 22, the first support arms 212 each have a regular lock contact portion 212*a*, a temporary lock contact portion 212*b*, and a coming-off preventive projection 212*c*.

As shown in FIG. 27, when fitting of all of the first to third housings 21-23 into the first connector housing 10 has completed, the regular lock contact portions 212*a* come into contact with respective regular lock projections 224 of the second housing 22 and thereby prevent movement of the second housing 22 in the coming-off direction (indicated by arrow Y2 in FIG. 27).

As shown in FIGS. 1 and 17, when the second housing 22 has been connected to the left side of the first housing 21, the tips of the temporary lock contact portions 212*b* come into contact with respective temporary lock projections 225 of the second housing 22 and thereby prevent slide movement of the second housing 22 with respect to the first housing 21 in the direction indicated by arrow Y3 in FIG. 17 and causes the second housing 22 to stay at the temporary lock position.

As shown in FIG. 17, when the second housing 22 is located at the temporary lock position with respect to the first housing 21, the coming-off preventive projections 212*c* are engaged with respective hook-shaped coming-off preventive lock portions 226 formed in the second housing 22 and thereby prevent slide movement of the second housing 22 with respect to the first housing 21 in the direction indicated by arrow Y4 in FIG. 17.

That is, the second housing 22 is positioned at the temporary lock position by the position restricting functions of the temporary lock contact portions 212*b* and the coming-off preventive projections 212*c* of the first support arms 212.

As shown in FIGS. 23 and 24, when fitting of the second housing 22 into the first connector housing 10 has completed, the coming-off preventive projections 212*c* go up onto the projected tips 15*b* of the second temporary lock cancellation projections 15 of the first connector housing 10, respectively. As a result, the first support arms 212 are deformed (bent) so that the temporary lock contact portions 212*b* are disengaged from the respective temporary lock projections 225, whereby the temporary lock state of the second housing 22 is canceled and the first housing 21 is allowed to make a slide movement with respect to the second housing 22 in the direction indicated by arrow Y6 in FIG. 24.

As shown in FIG. 17, when the second housing 22 is located at the temporary lock position, the tip position of the second housing 22 is closer to the first connector housing 10 than that of the first housing 21 by a length L1. This temporary lock position is set so that fitting of the second terminal metal fittings belonging to the second group into or with the associated ones of the first terminal metal fittings is completed earlier than fitting of the second terminal metal fittings belonging to the first group is.

As described above, the temporary lock state is canceled when the coming-off preventive projections 212*c* go up onto the projected tips 15*b* of the respective second temporary lock cancellation projections 15. As a result, the first housing 21 is allowed to make a slide movement with respect to the second housing 22 in the direction indicated by arrow Y6 in FIG. 24. A slide movement of the first housing 21 in the direction indicated by arrow Y6 is a relative displacement between the first housing 21 and the second housing 22 which is necessary for fitting of the second terminal metal fittings belonging to the first group into or with the associated ones of the first terminal metal fittings. In other words, the second housing 22 is connected to the first housing 21 on its left side at the prescribed position (temporary lock position) so as to be made slidable once the temporary lock state is canceled.

The pair of second support arms 213 project from the terminal housing/holding portion 211 on its right side. The second support arms 213 cooperate with the second slide fitting portion 215 to connect the third housing 23 to the terminal housing/holding portion 211 so that the former is located adjacent to the latter on the right side of the latter. As shown in FIG. 7, as a means for positioning the third housing 23, the second support arms 213 each have a regular lock contact portion 213*a*, a temporary lock contact portion 213*b*, and a coming-off preventive projection 213*c*.

As shown in FIG. 27, when fitting of all of the first to third housings 21-23 into the first connector housing 10 has completed, the regular lock contact portions 213*a* come into contact with respective regular lock projections 234 of the third housing 23 and thereby prevent movement of the third housing 23 in the coming-off direction (indicated by arrow Y2 in FIG. 27).

As shown in FIGS. 1 and 17, when the third housing 23 has been connected to the right side of the first housing 21, the tips of the temporary lock contact portions 213*b* come into contact with respective temporary lock projections 235 of the third housing 23 and thereby prevent slide movement of the third housing 23 with respect to the first housing 21 in the direction indicated by arrow Y3 in FIG. 17 and causes the third housing 23 to stay at the temporary lock position.

As shown in FIG. 17, when the third housing 23 is located at the temporary lock position with respect to the first housing 21, the coming-off preventive projections 213*c* are engaged with respective hook-shaped coming-off preventive lock portions 236 formed in the third housing 23 and thereby prevent slide movement of the third housing 23 with respect to the first housing 21 in the direction indicated by arrow Y4 in FIG. 17.

That is, the third housing 23 is positioned at the temporary lock position by the position restricting functions of the temporary lock contact portions 213*b* and the coming-off preventive projections 213*c* of the first support arms 212.

When fitting of the third housing 23 into the first connector housing 10 has completed, as shown in FIGS. 19 and 20 the coming-off preventive projections 213*c* go up onto the projected tips 16*b* of the third temporary lock cancellation projections 16 of the first connector housing 10, respectively. As a result, the second support arms 213 are deformed (bent) so that the temporary lock contact portions 213*b* are disengaged from the respective temporary lock projections 235, whereby the temporary lock state of the third housing 23 is canceled and the first housing 21 is allowed to make a slide movement with respect to the third housing 23 in the direction indicated by arrow Y7 in FIG. 20.

As shown in FIG. 17, when the third housing 23 is located at the temporary lock position, the tip position of the third housing 23 is closer to the first connector housing 10 than that of the second housing 22 by a length L2. This temporary lock position is set so that fitting of the second terminal metal fittings belonging to the third group into or with the associated ones of the first terminal metal fittings is completed earlier than fitting of the second terminal metal fittings belonging to the second group is.

As described above, the temporary lock state is canceled when the coming-off preventive projections 213*c* go up onto the projected tips 16*b* of the respective third temporary lock cancellation projections 16. As a result, the first housing 21 is allowed to make a slide movement with respect to the third housing 23 in the direction indicated by arrow Y7 in FIG. 20. When the first housing 21 is moved in the direction indicated by arrow Y7, the second housing 22 is moved together with the first housing 21. Therefore, a slide movement of the first housing 21 in the direction indicated by arrow Y7 is a relative displacement between the second housing 22 and the third housing 23 which is necessary for fitting of the second terminal metal fittings belonging to the second group which are held by the second housing 22 into or with the associated ones of the first terminal metal fittings. In other words, the third housing 23 is connected to the first housing 21 on its right side at the prescribed position (temporary lock position) so as to be made slidable once the temporary lock state is canceled.

As mentioned above, when the first housing 21 is moved in the direction indicated by arrow Y7 in FIG. 20 after cancellation of the temporary lock state of the third housing 23, the second housing 22 is moved together with the first housing 21.

As shown in FIG. 8, the first slide fitting portion 214 is a guide projection which extends in the direction (indicated by arrow Y5 in FIG. 8) of fitting of the second connector housing 20 into the first connector housing 10. A right side portion of the second housing 22 is fitted with the first slide fitting portion 214 slidably in the direction indicated by arrow Y5.

A top portion 214*a* of the first slide fitting portion 214 shown in FIG. 8 serves as a housing lock portion which causes the second housing 22 to follow a detachment action of the first housing 21 by coming into contact with a confronting surface 222*a* (see FIG. 12) of a slide fitting groove 222 of the second housing 22 when the second connector housing 20 is detached from the first connector housing 10.

As shown in FIG. 9, the second slide fitting portion 215 is a guide projection which extends in the direction (indicated by arrow Y6 in FIG. 9) of fitting of the second connector housing 20 into the first connector housing 10. A left side portion of the third housing 23 is fitted with the second slide fitting portion 215 slidably in the direction indicated by arrow Y6.

A top portion 215*a* of the second slide fitting portion 215 shown in FIG. 9 serves as a housing lock portion which causes the third housing 23 to follow a detachment action of the first housing 21 by coming into contact with a confronting surface 232*a* (see FIG. 15) of a slide fitting groove 232 of the third housing 23 when the second connector housing 20 is detached from the first connector housing 10.

When fitting of the second connector housing 20 into the first connector housing 10 is completed, the lock portion 217 is engaged with a lock portion 18 (see FIG. 2) of the first connector housing 10 to establish a state that the connector housings 10 and 20 are locked on each other.

The manipulation portion 218 is a grip portion to be held by fingers in making a manipulation for inserting or pulling the second connector housing 20 into or out of the first connector housing 10.

To detach the second connector housing 20 from the first connector housing 10, a user hooks his or her fingers on the manipulation portion 218 and makes a manipulation of pulling the first housing 21 from the first connector housing 10. As a result, the second terminal metal fittings are detached from the first terminal metal fittings in order of the first group, the second group, and the third group according to a procedure that is opposite to the procedure that is followed at the time of a fitting manipulation. When the second connector housing 20 is detached from the first connector housing 10, the second housing 22 is connected to the first housing 21 by the first support arms 212 at the prescribed position on the left side of the latter and the third housing 23 is connected to the first housing 21 by the second support arms 213 at the prescribed position on the right side of the latter.

As shown in FIG. 10, the second housing 22 has a terminal housing/holding portion 221, the slide fitting groove 222 which is formed in one side surface 221*a* of the terminal housing/holding portion 221, the regular lock projection 224, the temporary lock projections 225, and the hook-shaped coming-off preventive lock portions 226.

As shown in FIG. 10, the terminal housing/holding portion 221 has plural terminal housing holes 221*b* which are through-holes for housing and holding the second terminal metal fittings belonging to the second group.

The side surface 221*a* of the terminal housing/holding portion 221 is a surface to be opposed to the left side surface of the terminal housing/holding portion 211.

The slide fitting groove 222 is the groove to be fitted slidably with the first slide fitting portion 214 of the first housing 21.

As shown in FIG. 27, when fitting of all of the first to third housings 21-23 into the first connector housing 10 has completed, the regular lock contact portions 212*a* of the first support arms 212 come into contact with the respective regular lock projections 224 and thereby prevent movement of the second housing 22 in the coming-off direction (indicated by arrow Y2). Thus, the second housing 22 is kept fitted in the first connector housing 10.

As shown in FIG. 17, the temporary lock contact portions 212*b* come into contact with the respective temporary lock projections 225 while the second housing 22 is connected slidably to the first housing 21 from its left side through the fitting of the first slide fitting portion 214 with the slide fitting groove 222. As a result, the second housing 22 is temporarily kept at the temporary lock position.

The temporary lock position of the second housing 22 is the prescribed position where the second housing 22 is temporarily locked on the first housing 21 on the left side of the latter when the second connector housing 20 is fitted into the first connector housing 10 in the manner shown in FIG. 1.

As shown in FIGS. 1 and 17, when the second housing 22 is located at the temporary lock position with respect to the first housing 21, the hook-shaped coming-off preventive lock portions 226 are engaged with the coming-off preventive projections 212*c* of the first support arms 212, respectively, and thereby prevent movement of the second housing 22 in the direction indicated by arrow Y4 in FIG. 17.

As shown in FIGS. 13-15, the third housing 23 has the terminal housing/holding portion 231, the slide fitting groove 232 which is formed in one side surface 231*a* (see FIG. 15) of the terminal housing/holding portion 231, the regular lock projection 234, the temporary lock projections 235, and the hook-shaped coming-off preventive lock portions 236.

As shown in FIG. 13, the terminal housing/holding portion 231 has plural terminal housing holes 231*b* which are through-holes for housing and holding the second terminal metal fittings belonging to the third group.

The side surface 231*a* of the terminal housing/holding portion 231 is a surface to be opposed to the right side surface of the terminal housing/holding portion 211.

The slide fitting groove 232 is the groove to be fitted slidably with the second slide fitting portion 215 of the first housing 21.

As shown in FIG. 27, when fitting of all of the first to third housings 21-23 into the first connector housing 10 has completed, the regular lock contact portions 213*a* of the second support arms 213 come into contact with the respective regular lock projections 234 and thereby prevent movement of the third housing 23 in the coming-off direction (indicated by arrow Y2). Thus, the third housing 23 is kept fitted in the first connector housing 10.

As shown in FIG. 17, the temporary lock contact portions 213*b* come into contact with the respective temporary lock projections 235 while the third housing 23 is connected slidably to the first housing 21 from its right side through the fitting of the second slide fitting portion 215 with the slide fitting groove 232. As a result, the third housing 23 is temporarily kept at the temporary lock position.

The temporary lock position of the third housing 23 is the prescribed position where the third housing 23 is temporarily locked on the first housing 21 on the right side of the latter when the second connector housing 20 is fitted into the first connector housing 10 in the manner shown in FIG. 1.

As shown in FIGS. 1 and 17, when the third housing 23 is located at the temporary lock position with respect to the first housing 21, the hook-shaped coming-off preventive lock portions 236 are engaged with the coming-off preventive projections 213*c* of the second support arms 213, respectively, and thereby prevent movement of the third housing 22 in the direction indicated by arrow Y4 in FIG. 17.

Next, how the above-described insertion/extraction force reducing connector 1 according to the embodiment operates when the second connector housing 20 is inserted into or pulled out of the first connector housing 10 will be described with reference to FIGS. 16-29.

To fit the second connector housing 20 into the first connector housing 10, first, as shown in FIGS. 16-18, in the second connector housing 20 the second housing 22 is connected to the first housing 21 at the temporary lock position on the left side (as viewed in FIG. 1) of the latter in advance and the third housing 23 is connected to the first housing 21 at the temporary lock position on the right side (as viewed in FIG. 1) of the latter in advance.

Then, as shown in FIGS. 19 and 20, the first housing 21 on which the second housing 22 and the third housing 23 are lock temporarily is inserted into the hood part 12 of the first connector housing 10. Then, as shown in FIG. 20, the third housing 23 is inserted to the prescribed position in the first connector housing 10 to establish a state that the third housing 23 is fitted in the first connector housing 10 (i.e., the second terminal metal fittings of the third housing 23 are fitted in or with the associated ones of the first terminal metal fittings of the first connector housing 10). In this state, as shown in FIGS. 21 and 22, the coming-off preventive projections 213*c* of the second support arms 213 go up onto the projected tips 16*b* of the third temporary lock cancellation projections 16 of the hood part 12, whereby the temporary lock state of the third housing 23 is canceled.

The cancellation of the temporary lock state of the third housing 23 results in a state that relative displacement between the third housing 23 and the first housing 21 which is necessary for fitting of the second terminal metal fittings belonging to the second group into or with the associated ones of the first terminal metal fittings is possible. That is, the first housing 12 is allowed to make a slide movement in the direction indicated by arrow Y9 in FIG. 20. As the first housing 12 is allowed to make a slide movement in the direction indicated by arrow Y9 in FIG. 20, the second housing 22 is moved together with the first housing 12.

Since the first housing 12 makes a slide movement in the direction indicated by arrow Y9 in FIG. 20, as shown in FIGS. 23 and 24 the second housing 22 is inserted to the prescribed position in the first connector housing 10 to establish a state that the second housing 22 is fitted in the first connector housing 10 (i.e., the second terminal metal fittings of the second housing 22 are fitted in or with the associated ones of the first terminal metal fittings of the first connector housing 10; see FIG. 24). In this state, as shown in FIGS. 25 and 26, the coming-off preventive projections 212*c* of the first support arms 212 go up onto the projected tips 15*b* of the second temporary lock cancellation projections 15 of the hood part 12, whereby the temporary lock state of the second housing 22 is canceled.

The cancellation of the temporary lock state of the second housing 22 results in a state that relative displacement between the second housing 22 and the first housing 21 which is necessary for fitting of the second terminal metal fittings belonging to the first group with the associated ones of the first terminal metal fittings is possible. That is, the first housing 12 is allowed to make a slide movement in the direction indicated by arrow Y6 in FIG. 24.

As a result of the slide movement of the first housing 21 in the direction indicated by arrow Y6 in FIG. 24, the fitting of all of the first housing 21, the second housing 22, and the third housing 23 is completed as shown in FIG. 28 into the first connector housing 10. As shown in FIG. 29, a state is established that the lock portion 217 of the first housing 21 is engaged with the lock portion 18 of the first connector housing 10 and the second connector housing 20 is thereby locked on the first connector housing 10.

To detach the second connector housing 20 from the first connector housing 10, the lock portions 217 is disengaged from the lock portion 18 and the manipulation portion 218 is pulled in the direction indicated by arrow Y10 in FIG. 29. As a result, the second connector housing 20 is pulled out of the first connector housing 10.

While a manipulation for detaching the second connector housing 20 is being made, the second terminal metal fittings are detached from the first terminal metal fittings in order of the first group, the second group, and the third group according to a procedure that is opposite to the procedure that was followed at the time of a fitting manipulation. When the second connector housing 20 is detached from the first connector housing 10, the same state as at the time of the start of the fitting manipulation is restored, that is, the second housing 22 is connected to the first housing 21 by the first support arms 212 at the temporary lock position on the left side (as viewed in FIG. 1) of the latter and the third housing 23 is connected to the first housing 21 by the second support arms 213 at the temporary lock position on the right side (as viewed in FIG. 1) of the latter.

In the above-described insertion/extraction force reducing connector 1 according to the embodiment, the second terminal metal fittings are held so as to be divided into three groups by the second connector housing 20 which is to be fitted into the first connector housing 10. When the second connector housing 20 is inserted into or pulled out of the first connector housing 10, the sets of second terminal metal fittings belonging to the respective groups are engaged with or pulled out of the associated sets of first terminal metal fittings of the first connector housing 10 in order on a group-by-group basis, with timing of the engagement or pulling-out delayed. Therefore, the manipulation force that is necessary in inserting or pulling the second connector housing 20 into or out of the first connector housing 10 can be made weaker than in the case that all the second terminal metal fittings held by the second connector housing 20 are engaged with or pulled out of the first terminal metal fittings at one time.

The first housing 21 and the second housing 22 which are parts of the second connector housing 20 are connected to each other using the first support arms 212 which are integrally formed with the first housing 21, and the first housing 21 and the third housing 23 which are parts of the second connector housing 20 are connected to each other using the second support arms 213 which are integrally formed with the first housing 21.

Therefore, the total volume and weight of the members that are necessary for the connections between the housings can be made much smaller than in the conventional connector in which the inner housing space in which the inner housing is inserted for attachment is formed in the outer housing.

As a result, not only can the manipulation force that is necessary in inserting or pulling the second connector housing 20 into or out of the first connector housing 10 be reduced, but they can also be reduced in size and weight effectively.

In the insertion/extraction force reducing connector 1 according to the embodiment, at the time of a detachment manipulation for detaching the second connector housing 20 from the first connector housing 10, the same state as at the time of the start of a fitting manipulation is restored, that is, the second housing 22 is connected to the first housing 21 by the first support arms 212 at the temporary lock position on the left side of the latter and the third housing 23 is connected to the first housing 21 by the second support arms 213 at the temporary lock position on the right side of the latter. Therefore, to fit the second connector housing 20 which has been detached from the first connector housing 10 into the first connector housing 10 again, no time and labor to adjust the positional relationships between the first housing 21, the second housing 22, and the third housing 23 which are parts of the second connector housing 20 are necessary. Thus, the second connector housing 20 can be re-connected to the first connector housing 10 easily, which means high ease of handling.

In the insertion/extraction force reducing connector 1 according to the embodiment, the second terminal metal fittings are held by the second connector housing 20 so as to be divided into three groups. When the second connector housing 20 is inserted into or pulled out of the first connector housing 10, the sets of second terminal metal fittings belonging to the respective groups are engaged with or pulled out of the associated sets of first terminal metal fittings of the first connector housing 10 in order on a group-by-group basis. Therefore, the manipulation force that is necessary in inserting or pulling the second connector housing 20 into or out of the first connector housing 10 can be made weaker than in the case that the second terminal metal fittings are divided into two groups and are engaged with or pulled out of the first terminal metal fittings of a first connector housing in order on a group-by-group basis, by a degree corresponding to the increase in the number of division.

The invention is not limited the above embodiment, and modifications, improvements, etc. can be made as appropriate. And the material, shape, dimensions, number, location, etc. of each constituent element (or each set of constituent elements) of the embodiment are arbitrary and are not restricted as long as the invention can be implemented.

For example, in the embodiment, the second terminal metal fittings are held by the second connector housing 20 so as to be divided into three groups and the sets of second terminal metal fittings belonging to the respective groups are engaged with or pulled out of the associated sets of first terminal metal fittings in order on a group-by-group basis with timing of the engagement or pulling-out delayed, whereby the manipulation force that is necessary in inserting or pulling the second connector housing 20 can be reduced.

On the other hand, the size and the weight can be made smaller than in the conventional case by such structures that the housings constituting the second connector housing are connected to each other using the support arms which extend from the first housing. It is therefore possible to divide the second terminal metal fittings held by the second connector housing into two groups.

The features of the above-described insertion/extraction force reducing connector according to the embodiment of the invention are summarized below as items [1] to [4]:

[1] An insertion/extraction force reducing connector (1) comprising:

a first connector housing (10) having a first terminal holding part (11) which holds plural first terminal metal fittings and a hood part (12) which extends cylindrically from a front outer circumferential portion of the first terminal holding part (11) and to which a second connector housing (20) is to be connected; and the second connector housing (20) which holds plural second terminal metal fittings to be fitted into or with the respective first terminal metal fittings, and whose second terminal metal fittings are fitted with and connected to the respective first terminal metal fittings when the second connector housing (20) is fitted into the hood part (12), wherein the second connector housing (20) holds the second terminal metal fittings in such a manner that they are divided into plural groups, and when the second connector housing (20) is inserted into or pulled out of the first connector housing (10), sets of second terminal metal fittings belonging to the respective groups are engaged with or pulled out of associated sets of first terminal metal fittings in order on a group-by-group basis;

the second connector housing (20) comprises:

a first housing (21) which holds second terminal metal fittings belonging to a first group and is to be fitted into the hood part (12); and a second housing (22) which is positioned at a temporary lock position on one side of the first housing (21) by first support arms (212) which are integrally formed with the first housing (21) and are located on the one side of it, and which holds second terminal metal fittings belonging to a second group which are disposed adjacent to the second terminal metal fittings belonging to the first group on the one side of the latter; and the second housing (22) is connected slidably to a portion located on the one side of the first housing (21) so that during a fitting manipulation for fitting the second connector housing (20) into the first connector housing (10), fitting of the second terminal metal fittings belonging to the second group into or with corresponding ones of the first terminal metal fittings is completed earlier than fitting of the second terminal metal fittings belonging to the first group.

[2] The insertion/extraction force reducing connector (1) according to item [1], wherein when the fitting of the second terminal metal fittings belonging to the second group into or with the corresponding ones of the first terminal metal fittings has been completed, temporary locking of the second housing (22) on the first housing (21) by the first support arms (212) is canceled and relative displacement between the first housing (21) and the second housing (22) which is necessary for the fitting of the second terminal metal fittings belonging to the first group into or with the corresponding ones of the first terminal metal fittings is thereby permitted; and during a detachment manipulation for detaching the second connector housing (20) from the first connector housing (10), the second terminal metal fittings belonging to the first group and the second terminal metal fittings belonging to the second group are detached from the first terminal metal fittings in this order which is opposite to the order at the time of the fitting manipulation and the same state as at the time of a start of the fitting manipulation is restored that the second housing (22) is connected to the first housing (21) by the first support arms (212) at the temporary lock position on the one side of the first housing (21).

[3] The insertion/extraction force reducing connector (1) according to item [2], further comprising a third housing (23) which is positioned at a temporary lock position on the other side of the first housing (21) by second support arms (213) which are integrally formed with the first housing (21) and are located on the other side of it, and which holds second terminal metal fittings belonging to a third group which are disposed adjacent to the second terminal metal fittings belonging to the first group on the other side of the latter; and the third housing (23) is connected slidably to a portion, located on the other side, of the first housing (21) so that during the fitting manipulation for fitting the second connector housing (20) into the first connector housing (10) fitting of the second terminal metal fittings belonging to the third group into or with corresponding ones of the first terminal metal fittings is completed earlier than fitting of the second terminal metal fittings belonging to the second group is.

(4) The insertion/extraction force reducing connector (1) according to item [3], wherein when the fitting of the second terminal metal fittings belonging to the third group into or with the corresponding ones of the first terminal metal fittings has been completed, temporary locking of the third housing (23) on the first housing (21) by the second support arms (213) is canceled and relative displacement between the first housing (21) and the third housing (23) which is necessary for the fitting of the second terminal metal fittings belonging to the second group into or with the corresponding ones of the first terminal metal fittings is thereby permitted; and during the detachment manipulation for detaching the second connector housing (20) from the first connector housing (10), the second terminal metal fittings belonging to the first group, the second terminal metal fittings belonging to the second group, and the second terminal metal fittings belonging to the third group are detached from the first terminal metal fittings in this order which is opposite to the order at the time of the fitting manipulation and the same state as at the time of a start of the fitting manipulation is restored that the second housing (22) is connected to the first housing (21) by the first support arms (212) at the temporary lock position on the one side of the first housing (21) and the third housing (23) is connected to the first housing (21) by the second support arms (213) at the temporary lock position on the other side of the first housing (21).

This application is based upon and claims the benefit of priority of Japanese Patent Application 2012-185746 filed on Aug. 24, 2012, the contents of which are incorporated herein by reference.

What is claimed is:

1. A insertion/extraction force reducing connector, comprising:

a first connector housing having a first terminal holding part which holds plural first terminal metal fittings, and a hood part which extends cylindrically from a front outer circumferential portion of the first terminal holding part and to which a second connector housing is connected and fitted; and the second connector housing which holds plural second terminal metal fittings to be fitted with and connected to the respective first terminal metal fittings, and in which the second terminal metal fittings are fitted with and connected to the respective first terminal metal fittings when the second connector housing is fitted into the hood part;

wherein the second connector housing holds the second terminal metal fittings in such a manner that the second terminal metal fitting are divided into plural groups, and when the second connector housing is inserted into or pulled out of the first connector housing, sets of the second terminal metal fittings belonging to the respective groups are engaged with or pulled out of associated sets of first terminal metal fittings in order on a group-by-group basis;

the second connector housing comprises:

a first housing which holds second terminal metal fittings belonging to a first group and is to be fitted into the hood part; and a second housing which is positioned at a temporary lock position on one side of the first housing by a first support arm which is integrally formed with the first housing and is located on the one side of the first housing and which holds second terminal metal fittings belonging to a second group which are disposed adjacent to the second terminal metal fittings belonging to the first group on the one side of the first housing; and the second housing is connected slidably to a portion located on the one side of the first housing so that during a fitting manipulation for fitting the second connector housing into the first connector housing, fitting of the second terminal metal fittings belonging to the second group with corresponding ones of the first terminal metal fittings is completed earlier than fitting of the second terminal metal fittings belonging to the first group.

2. The insertion/extraction force reducing connector according to claim 1, wherein, when the fitting of the second terminal metal fittings belonging to the second group with the corresponding ones of the first terminal metal fittings has been completed, temporary locking of the second housing on the first housing by the first support arm is canceled and relative displacement between the first housing and the second housing which is necessary for the fitting of the second terminal metal fittings belonging to the first group into or with the corresponding ones of the first terminal metal fittings is thereby permitted; and during a detachment manipulation for detaching the second connector housing from the first connector housing, the second terminal metal fittings belonging to the first group and the second terminal metal fittings belonging to the second group are detached from the first terminal metal fittings in this order which is opposite to the order at time of the fitting manipulation and the same state as at the time of a start of the fitting manipulation is restored that the second housing is connected to the first housing by the first support arm at the temporary lock position on the one side of the first housing.

3. The insertion/extraction force reducing connector according to claim 2, further comprising a third housing positioned at a temporary lock position on an opposite side of the first housing by a second support arm which is integrally formed with the first housing and is located on the opposite side of the first housing, and which holds second terminal metal fittings belonging to a third group which are disposed adjacent to the second terminal metal fittings belonging to the first group; and the third housing is connected slidably to a portion located on the opposite side of the first housing so that during the fitting manipulation for fitting the second connector housing into the first connector housing, fitting of the second terminal metal fittings belonging to the third group with corresponding ones of the first terminal metal fittings is completed earlier than fitting of the second terminal metal fittings belonging to the second group.

4. The insertion/extraction force reducing connector according to claim 3, wherein, when the fitting of the second terminal metal fittings belonging to the third group with the corresponding ones of the first terminal metal fittings has been completed, temporary locking of the third housing on the first housing by the second support arm is canceled and relative displacement between the first housing and the third housing which is necessary for the fitting of the second terminal metal fittings belonging to the second group into or with the corresponding ones of the first terminal metal fittings is thereby permitted; and during the detachment manipulation for detaching the second connector housing from the first connector housing, the second terminal metal fittings belonging to the first group, the second terminal metal fittings belonging to the second group, and the second terminal metal fittings belonging to the third group are detached from the first terminal metal fittings in this order which is opposite to the order at the time of the fitting manipulation and the same state as at the time of a start of the fitting manipulation is restored that the second housing is connected to the first housing by the first support arm at the temporary lock position on the one side of the first housing and the third housing is connected to the first housing by the second support arm at the temporary lock position on the opposite side of the first housing.

* * * * *